US005850051A

United States Patent [19]

Machover et al.

[11] Patent Number: 5,850,051

[45] Date of Patent: Dec. 15, 1998

[54] METHOD AND APPARATUS FOR CREATING AN AUTOMATIC ACCOMPANIMENT PATTERN ON THE BASIS OF ANALYTIC PARAMETERS

[75] Inventors: Tod Machover, Belmont; Alex Rigopulos, Boxford; Fumiaki Matsumoto, Brookline, all of Mass.

[73] Assignee: Yamaha Corporation, Hamamatsu, Japan

[21] Appl. No.: 698,136

[22] Filed: Aug. 15, 1996

[51] Int. Cl.[6] ..... G10H 1/36; G10H 7/00

[52] U.S. Cl. ..... 84/634; 84/610; 84/613; 84/637

[58] Field of Search ..... 84/609, 610, 613, 84/634, 637

[56] References Cited

U.S. PATENT DOCUMENTS

| | | | |
|---|---|---|---|
| 5,220,118 | 6/1993 | Konishi | 84/609 |
| 5,221,801 | 6/1993 | Bruti et al. . | |
| 5,241,125 | 8/1993 | Miyamoto | 84/609 |
| 5,308,915 | 5/1994 | Ohya et al. | 84/601 |
| 5,399,799 | 3/1995 | Gabriel | 84/609 |
| 5,453,569 | 9/1995 | Saito et al. | 84/609 |
| 5,481,066 | 1/1996 | Kitamura | 84/637 |
| 5,495,073 | 2/1996 | Fujishima et al. | 84/609 |
| 5,496,962 | 3/1996 | Meier et al. | 84/609 X |

*Primary Examiner*—William M. Shoop, Jr.
*Assistant Examiner*—Jeffrey W. Donels
*Attorney, Agent, or Firm*—Graham & James LLP

[57] ABSTRACT

Optional accompaniment patterns are created on the basis of a plurality of parameters. Thus, by changing the values of the parameters to be supplied as necessary, accompaniment patterns can be created in an unconstrained manner. By time-varying at least one of the parameters, an optional accompaniment pattern can be created in such a manner that a desired accompaniment tone is sounded at a desired time point, and an accompaniment pattern can be changed freely. A performance state of an performance operator such as a keyboard may be detected, so as to change the parameters on the basis of performance states detected at least for a current time and a given past time. This permits parameter control reflecting a changing real-time performance state. Alternatively, a parameter may be prepared in accordance with input performance information so that an accompaniment pattern is created on the basis of the prepared parameter. At least one of the parameters may be modulated in real time via a relatively simple operator such as a modulation wheel.

32 Claims, 20 Drawing Sheets

```
CHORD VOICE NUMBER:CHORD PATCH 28
BASS VOICE NUMBER:BASS PATCH 32
TEMPO:90
CHORD
 (BEATS 4)
  (DURATION(0 21) (96 21))
  (REGISTER(0 60) (96 60))
  (NUM NOTES(0 124) (96 124))
  (ACTIVITY(0 2) (12 2) (12 124) (24 124) (24 2) (36 2) (36 122) (48 122) (48 2)
            (55 2) (55 3) (60 3) (60 124) (72 124) (72 3) (84 3) (84 123) (96 123))
  (VOLUME(0 49) (96 49))
  (RANGE(0 60) (96 60))
  (SUB-RANGE(0 47) (96 47))
  (DENSITY(0 64) (96 64))
  (SYNCOPATION(0 125) (12 125) (12 3) (24 3) (24 126) (36 126) (36 3) (48 3)
  (48 125) (60 125) (60 3) (72 3) (72 125) (79 125) (79 124) (84 124) (84 4) (96 4))
)
BASS
 (BEATS 4)
  (DULL TONE(0 3) (48 3) (48 111) (72 111) (72 69) (96 69))
  (ACTIVITY(0 63) (72 63) (72 126) (85 126) (85 127) (96 127))
  (VOLUME(0 88) (96 88))
  (LEAPER(0 10) (7 10) (7 9) (12 9) (12 29) (13 29) (13 10) (24 10) (24 84) (25 84)
          (25 7) (31 7) (31 8) (36 8) (36 29) (37 29) (37 9) (49 9) (49 10) (60 10)
          (60 29) (61 29) (61 9) (79 9) (79 10) (96 10))
  (CHORD TONE(0 84) (96 84))
  (SYNCOPATION(0 19) (96 19)
  (DIRECTION(0 113) (48 113) (48 7) (90 7) (90 75) (96 75))
)
```

| SLOT | SYNCO -PATION =0 | SYNCO -PATION =31 | SYNCO -PATION =63/64 | SYNCO -PATION =95 | SYNCO -PATION =127 |
|---|---|---|---|---|---|
| 0 | 15 | 7.5 | 0 | −7.5 | −15 |
| 12 | 0 | 5 | 10 | 15 | 20 |
| 24 | 15 | 7.5 | 0 | −7.5 | −15 |
| 36 | 0 | 5 | 10 | 15 | 20 |
| 48 | 15 | 7.5 | 0 | −7.5 | −15 |
| 60 | 0 | 5 | 10 | 15 | 20 |
| 72 | 15 | 7.5 | 0 | −7.5 | −15 |
| 84 | 0 | 5 | 10 | 15 | 20 |

TOTAL VALUE OF EIGHTH NOTE

FIG. 5A

| SLOT | SYNCO -PATION =0 | SYNCO -PATION =31 | SYNCO -PATION =63/64 | SYNCO -PATION =95 | SYNCO -PATION =127 |
|---|---|---|---|---|---|
| 0 | 15 | 7.5 | 0 | −7.5 | −15 |
| 6 | 0 | 5 | 10 | 15 | 20 |
| 12 | 10 | 5 | 0 | −5 | −10 |
| 18 | 0 | 5 | 10 | 15 | 20 |
| 24 | 15 | 7.5 | 0 | −7.5 | −15 |
| 30 | 0 | 5 | 10 | 15 | 20 |
| 36 | 10 | 5 | 0 | −5 | −10 |
| 42 | 0 | 5 | 10 | 15 | 20 |
| 48 | 15 | 7.5 | 0 | −7.5 | −15 |
| 54 | 0 | 5 | 10 | 15 | 20 |
| 60 | 10 | 5 | 0 | −5 | −10 |
| 66 | 0 | 5 | 10 | 15 | 20 |
| 72 | 15 | 7.5 | 0 | −7.5 | −15 |
| 78 | 0 | 5 | 10 | 15 | 20 |
| 84 | 10 | 5 | 0 | −5 | −10 |
| 90 | 0 | 5 | 10 | 15 | 20 |

TOTAL VALUE OF SIXTEENTH NOTE

FIG. 5B

| MAJOR | C | C# | D | D# | E | F | F# | G | G# | A | A# | B |
|---|---|---|---|---|---|---|---|---|---|---|---|---|
| CHORD TONE | ● | | | | ● | | | ● | | | | |
| DULL TONE | | | ● | | | ● | | | | ● | | ● |
| RIPE TONE | | ● | | ● | | | ● | | ● | | ● | |

FIG. 6A

| MINOR | C | C# | D | D# | E | F | F# | G | G# | A | A# | B |
|---|---|---|---|---|---|---|---|---|---|---|---|---|
| CHORD TONE | ● | | | ● | | | | ● | | | | |
| DULL TONE | | | ● | | | ● | | | ● | | ● | |
| RIPE TONE | | ● | | | ● | | ● | | | ● | | ● |

FIG. 6B

| MIN 7 | C | C# | D | D# | E | F | F# | G | G# | A | A# | B |
|---|---|---|---|---|---|---|---|---|---|---|---|---|
| CHORD TONE | ● | | | ● | | | | ● | | | ● | |
| DULL TONE | | | ● | | | ● | | | | ● | | |
| RIPE TONE | | ● | | | ● | | ● | | ● | | | ● |

FIG. 6C

| DOM 7 | C | C# | D | D# | E | F | F# | G | G# | A | A# | B |
|---|---|---|---|---|---|---|---|---|---|---|---|---|
| CHORD TONE | ● | | | | ● | | | ● | | | ● | |
| DULL TONE | | | ● | | | ● | | | | ● | | |
| RIPE TONE | | ● | | ● | | | ● | | ● | | | ● |

FIG. 6D

| NOTE | DENSITY | | | |
|---|---|---|---|---|
| | 127 | 64 | 32 | 16～0 |
| 36：C1 | 2 | 4 | 6 | 12 |
| 48：C2 | 1 | 3 | 5 | 10 |
| 60：C3 | 1 | 3 | 4 | 8 |
| 72：C4 | 1 | 3 | 3 | 6 |
| 84：C5 | 1 | 1 | 2 | 4 |
| 96：C6 | 1 | 1 | 1 | 2 |

FIG. 7

| NUM NOTE | SUB-RANGE | BOTTOM PITCH 36 | 40 | 45 | 53 | 57 | 60 | 64 | 72 | 75 | 79 | 81 | TOP PITCH 88 |
|---|---|---|---|---|---|---|---|---|---|---|---|---|---|
| 8 | 60 | | ● | ● | ● | ● | | ● | ● | | ● | ● | |
| 4 | 60 | | | | ● | ● | | ● | ● | | | | |
| 2 | 60 | | | | | ● | | ● | | | | | |
| 4 | 45 | ● | ● | ● | ● | | | | | | | | |
| 2 | 45 | | ● | ● | | | | | | | | | |
| 4 | 75 | | | | | | | ● | ● | | ● | ● | |
| 2 | 75 | | | | | | | | ● | | ● | | |

FIG. 21

FIG. 8A

| MAJOR | C | C# | D | D# | E | F | F# | G | G# | A | A# | B |
|---|---|---|---|---|---|---|---|---|---|---|---|---|
| REQUIRED | ● | | | | ● | | | ● | | | | |
| OPTIONAL 1 | ● | | ● | | ● | ● | | ● | | ● | ● | |
| OPTIONAL 2 | ● | | ● | | ● | | ● | ● | | ● | | ● |

FIG. 8B

| MINOR | C | C# | D | D# | E | F | F# | G | G# | A | A# | B |
|---|---|---|---|---|---|---|---|---|---|---|---|---|
| REQUIRED | ● | | | ● | | | | ● | | | | |
| OPTIONAL 1 | ● | | ● | ● | | ● | | ● | | ● | ● | |
| OPTIONAL 2 | ● | | ● | ● | | | ● | ● | | ● | | ● |

FIG. 8C

| MIN7 | C | C# | D | D# | E | F | F# | G | G# | A | A# | B |
|---|---|---|---|---|---|---|---|---|---|---|---|---|
| REQUIRED | ● | | | ● | | | | ● | | | ● | |
| OPTIONAL 1 | ● | | ● | ● | | ● | | ● | | ● | ● | |
| OPTIONAL 2 | ● | ● | | ● | ● | | ● | ● | ● | | ● | |

FIG. 8D

| DOM7 | C | C# | D | D# | E | F | F# | G | G# | A | A# | B |
|---|---|---|---|---|---|---|---|---|---|---|---|---|
| REQUIRED | ● | | | | ● | | | ● | | | ● | |
| OPTIONAL 1 | ● | | ● | | ● | ● | | ● | | ● | ● | |
| OPTIONAL 2 | ● | ● | | ● | ● | | ● | ● | ● | | ● | |

```
MIDI TRACK:(RHYTHM TIME(FLAG  NOTE VELOCITY  DURATION  MIDI CHAN  PORT)

((SCORE
        (0(MESSAGE 1 0))
        (0(NOTE 36 84 77 9 0))
        (0(NOTE 42 73 152 9 0))
        (240(NOTE 46 79 66 9 0))
        (480(MESSAGE 2 0))
        (480(NOTE 40 64 90 9 0))
        (480(NOTE 42 70 135 9 0))
        (720(NOTE 46 67 65 9 0))
        (840(NOTE 36 71 113 9 0))
        (960(MESSAGE 3 0))                    PATTERN#0
        (960(NOTE 42 81 179 9 0))
        (1200(NOTE 46 68 66 9 0))
        (1200(NOTE 46 68 66 9 0))
        (1440(MESSAGE 4 0))
        (1440(NOTE 40 68 109 9 0))
        (1440(NOTE 42 79 155 9 0))
        (1680(NOTE 36 73 67 9 0))
        (1680(NOTE 46 67 68 9 0))
        (1920(REPEAT 1 T 0))
)
                .
                .
                .
((SCORE
        (0(MESSAGE 1 0))
        (0(NOTE 36 84 77 9 0))
        (0(NOTE 42 73 152 9 0))
        (240(NOTE 46 79 66 9 0))
        (480(MESSAGE 2 0))
        (480(NOTE 40 64 90 9 0))
        (480(NOTE 42 70 135 9 0))
        (840(NOTE 36 71 113 9 0))             PATTERN#n
                .
                .
                .
        (1440(NOTE 40 68 109 9 0))
        (1440(NOTE 42 79 155 9 0))
        (1680(NOTE 36 73 67 9 0))
        (1680(NOTE 46 67 68 9 0))
        (1920(REPEAT 1 T 0))
)
```

FIG. 9

| | PEACE–PEACE | | | | | | | | | PEACE–NOISE | | | | | | | | |
|---|---|---|---|---|---|---|---|---|---|---|---|---|---|---|---|---|---|---|
| | BASS | | | CHORD | | | DRUM | | | BASS | | | CHORD | | | DRUM | | |
| | T | G | S | T | G | S | T | G | S | T | G | S | T | G | S | T | G | S |
| VOLUME | 0 | 0 | 0 | 0 | 0 | 30 | 0 | 0 | 0 | 1 | 0 | 0 | 0 | −1 | 15 | 0 | 0 | 0 |
| ACTIVITY | 0 | 0 | 0 | 0 | 0 | 50 | 0 | 0 | 0 | 1 | 0 | 0 | 0 | 0 | 30 | 0 | 0 | 0 |
| SYNCOPATION | 0 | 0 | 0 | 0 | 0 | 0 | 0 | 0 | 0 | 1 | 0 | 0 | 0 | 0 | 0 | 0 | 0 | 0 |
| DUP/TRIP | 0 | 0 | 0 | 0 | 0 | 0 | 0 | 0 | 0 | 0 | 0 | 0 | 0 | 0 | 0 | 0 | 0 | 0 |
| CHORD TONE | 0 | 0 | 0 | * | * | * | * | * | * | 0 | 0 | 0 | * | * | * | * | * | * |
| RIPE TONE | 0 | 0 | 0 | * | * | * | * | * | * | 0 | 0 | 0 | * | * | * | * | * | * |
| DULL TONE | 0 | 0 | 0 | * | * | * | * | * | * | 0 | 0 | 0 | * | * | * | * | * | * |
| SCALE DUR | 0 | 0 | 0 | * | * | * | * | * | * | 1 | 0 | 0 | * | * | * | * | * | * |
| LEAPER | 0 | 0 | 0 | * | * | * | * | * | * | 0 | 0 | 0 | * | * | * | * | * | * |
| DIRECTION | 0 | 0 | 0 | * | * | * | * | * | * | 0 | 0 | 0 | * | * | * | * | * | * |
| REGISTER | 0 | 0 | 0 | * | * | * | * | * | * | 0 | 0 | 0 | * | * | * | * | * | * |
| RANGE | * | * | * | 0 | 0 | 0 | * | * | * | * | * | * | 0 | 0 | 0 | * | * | * |
| SUB-RANGE | * | * | * | 0 | 0 | 0 | * | * | * | * | * | * | 0 | 0 | 0 | * | * | * |
| NUM NOTES | * | * | * | 0 | 0 | 0 | * | * | * | * | * | * | 0 | 0 | 0 | * | * | * |
| DENSITY | * | * | * | 0 | 0 | 0 | * | * | * | * | * | * | 0 | 0 | 0 | * | * | * |
| DURATION | * | * | * | 0 | 0 | 0 | * | * | * | * | * | * | 0 | 0 | 0 | * | * | * |
| COLOR-A | * | * | * | 0 | 0 | 0 | * | * | * | * | * | * | 0 | −1 | 0 | * | * | * |
| COLOR-B | * | * | * | 0 | 0 | 0 | * | * | * | * | * | * | 0 | 0 | 0 | * | * | * |

| | NOISE–PEACE | | | | | | | | | NOISE–NOISE | | | | | | | | |
|---|---|---|---|---|---|---|---|---|---|---|---|---|---|---|---|---|---|---|
| | BASS | | | CHORD | | | DRUM | | | BASS | | | CHORD | | | DRUM | | |
| | T | G | S | T | G | S | T | G | S | T | G | S | T | G | S | T | G | S |
| VOLUME | 2 | 1 | 0 | 2 | 0 | 15 | 0 | 0 | 0 | 0 | 2 | 0 | 0 | −1 | 0 | 1 | 0 | 0 |
| ACTIVITY | 2 | 0 | 0 | 2 | 0 | 30 | 0 | 0 | 0 | 0 | 2 | 0 | 0 | 0 | 0 | 1 | 0 | 0 |
| SYNCOPATION | 2 | 0 | 0 | 2 | 0 | 0 | 0 | 0 | 0 | 0 | 0 | 0 | 0 | 0 | 0 | 0 | 0 | 0 |
| DUP/TRIP | 0 | 0 | 0 | 0 | 0 | 0 | 0 | 0 | 0 | 0 | 0 | 0 | 0 | 0 | 0 | 0 | 0 | 0 |
| CHORD TONE | 2 | 0 | 0 | * | * | * | * | * | * | 0 | 0 | 0 | * | * | * | * | * | * |
| RIPE TONE | 2 | 1 | 0 | * | * | * | * | * | * | 0 | 2 | 0 | * | * | * | * | * | * |
| DULL TONE | 2 | 1 | 0 | * | * | * | * | * | * | 0 | 2 | 0 | * | * | * | * | * | * |
| SCALE DUR | 2 | 0 | 0 | * | * | * | * | * | * | 0 | 0 | 0 | * | * | * | * | * | * |
| LEAPER | 2 | 0 | 0 | * | * | * | * | * | * | 0 | 0 | 0 | * | * | * | * | * | * |
| DIRECTION | 2 | 1 | 0 | * | * | * | * | * | * | 0 | 2 | 0 | * | * | * | * | * | * |
| REGISTER | 0 | 0 | 0 | * | * | * | * | * | * | 0 | 0 | 0 | * | * | * | * | * | * |
| RANGE | * | * | * | 2 | 0 | 0 | * | * | * | * | * | * | 0 | 0 | 0 | * | * | * |
| SUB-RANGE | * | * | * | 2 | 0 | 0 | * | * | * | * | * | * | 0 | 0 | 0 | * | * | * |
| NUM NOTES | * | * | * | 2 | 0 | 0 | * | * | * | * | * | * | 0 | 0 | 0 | * | * | * |
| DENSITY | * | * | * | 2 | 0 | 0 | * | * | * | * | * | * | 0 | 0 | 0 | * | * | * |
| DURATION | * | * | * | 2 | 0 | 0 | * | * | * | * | * | * | 0 | 0 | 0 | * | * | * |
| COLOR-A | * | * | * | 2 | 0 | 0 | * | * | * | * | * | * | 0 | −2 | 0 | * | * | * |
| COLOR-B | * | * | * | 2 | 0 | 0 | * | * | * | * | * | * | 0 | 0 | 0 | * | * | * |

FIG. 15

| NOTE-ON PATTERN | ACTIVITY | | | | SYNCOPATION | | | |
|---|---|---|---|---|---|---|---|---|
| 0 0 0 0 | 0 | 0 | 0 | 0 | 0 | 0 | 0 | 0 |
| 1 0 0 0 | 1 | 1 | 1 | 1 | 0 | 0 | 0 | 0 |
| 0 1 0 0 | 120 | 1 | 120 | 1 | 80 | 0 | 80 | 0 |
| 1 1 0 0 | 120 | 1 | 120 | 1 | Vel[6]-Vel[0] | 0 | Vel[6]-Vel[0] | 0 |
| 0 0 1 0 | 60 | 60 | 60 | 60 | 40 | 40 | 40 | 40 |
| 1 0 1 0 | 60 | 60 | 60 | 60 | Vel[12]-Vel[0] | Vel[12]-Vel[0] | Vel[12]-Vel[0] | Vel[12]-Vel[0] |
| 0 1 1 0 | 120 | 60 | 120 | 60 | 40 | 40 | 40 | 40 |
| 1 1 1 0 | 120 | 60 | 120 | 60 | Vel[12]-Vel[0] | Vel[12]-Vel[0] | Vel[12]-Vel[0] | Vel[12]-Vel[0] |
| 0 0 0 1 | 0 | 120 | 0 | 120 | Vel[12]-Vel[0] | 80 | Vel[12]-Vel[0] | 80 |
| 1 0 0 1 | 1 | 120 | 1 | 120 | Vel[12]-Vel[0] | 80 | Vel[12]-Vel[0] | 80 |
| 0 1 0 1 | 120 | 120 | 120 | 120 | 80 | 80 | 80 | 80 |
| 1 1 0 1 | 120 | 120 | 120 | 120 | Vel[6]-Vel[0] | 80 | Vel[6]-Vel[0] | 80 |
| 0 0 1 1 | 60 | 120 | 60 | 120 | 40 | Vel[18]-Vel[12] | 40 | Vel[18]-Vel[12] |
| 1 0 1 1 | 60 | 120 | 60 | 120 | Vel[12]-Vel[0] | Vel[18]-Vel[12] | Vel[12]-Vel[0] | Vel[18]-Vel[12] |
| 0 1 1 1 | 120 | 120 | 120 | 120 | 40 | Vel[18]-Vel[12] | 40 | Vel[18]-Vel[12] |
| 1 1 1 1 | 120 | 120 | 120 | 120 | Vel[12]-Vel[0] | Vel[18]-Vel[12] | Vel[12]-Vel[0] | Vel[18]-Vel[12] |

FIG. 17

| MIMIC TEXTURE | | | | | AVERAGE VALUE (AV) |
|---|---|---|---|---|---|
| PARAMETER | BASS | CHORD | RHYTHM | | |
| ACTIVITY | ● | ● | ● | ⇨ ⇨ ⇨ | ACTIVITY |
| SYNCOPATION | ● | ● | ● | ⇨ ⇨ ⇨ | SYNCOPATION |
| VOLUME | ● | ● | ● | ⇨ ⇨ ⇨ | VOLUME |
| DURATION | — | ● | — | ⇨ ⇨ ⇨ | DURATION |
| SCAL DUR | ● | — | — | | — |
| CHORD TONE | ● | — | — | | — |
| DULL TONE | ● | — | — | ⇨ ⇨ ⇨ | COLOR-A |
| RIPE TONE | ● | — | — | ⇨ ⇨ ⇨ | COLOR-B |
| DIRECTION | ● | — | — | ⇨ ⇨ ⇨ | DIRECTION |
| LEAPER | ● | — | — | | — |
| NUM NOTES | — | ● | — | ⇨ ⇨ ⇨ | NUM NOTES |
| REGISTER | — | ● | — | ⇨ ⇨ ⇨ | REGISTER |
| RANGE | — | ● | — | ⇨ ⇨ ⇨ | RANGE |

FIG. 18A

| AVERAGE VALUE (AV) | | | | OFFSET TEXTURE BASS PARAMETE | OFFSET TEXTURE CHORD PARAMETER |
|---|---|---|---|---|---|
| ACTIVITY | ⇨ | (AV-64)/2 | ⇨ | ACTIVITY | ACTIVITY |
| SYNCOPATION | ⇨ | (AV-64)/2 | ⇨ | SYNCOPATION | SYNCOPATION |
| VOLUME | ⇨ | (AV-64)/2 | ⇨ | VOLUME | VOLUME |
| DURATION | ⇨ | (AV-64)/(-2) | ⇨ | SCALE DUR | DURATION |
| COLOR-A | ⇨ | (AV-64)/2 | ⇨ | DULL TONE | COLOR-A |
| COLOR-B | ⇨ | (AV-64)/2 | ⇨ | RIPE TONE | COLOR-B |
| DIRECTION | ⇨ | (AV-64)*2 | ⇨ | DIRECTION | — |
| NUM NOTES | ⇨ | (AV-64)/2 | ⇨ | — | DENSITY |
| REGISTER | ⇨ | (AV-64)/2 | ⇨ | — | REGISTER |
| RANGE | ⇨ | (AV-64)/2 | ⇨ | — | RANGE |

FIG. 18B

REGISTER=60, RANGE=60
(RANGE BOTTOM=30, RANGE TOP=90, DENSITY=64)

| MAJOR | C | C# | D | D# | E | F | F# | G | G# | A | A# | B |
|---|---|---|---|---|---|---|---|---|---|---|---|---|
| REQUIRED(=1) | ● | | | | ● | | | ● | | | | |
| OPTIONAL 1(=1) | ● | | ● | | ● | ● | | ● | | ● | ● | |
| OPTIONAL 2(=0) | ○ | | ○ | | ○ | | ○ | ○ | | ○ | | ○ |
| | | | | | | | | | | | | |
| C0 | | | | | | | 30 | 31 | 32 | 33 | 34 | 35 |
| C1 | 36 | 37 | 38 | 39 | 40 | 41 | 42 | 43 | 44 | 45 | 46 | 47 |
| C2 | 48 | 49 | 50 | 51 | 52 | 53 | 54 | 55 | 56 | 57 | 58 | 59 |
| C3 | 60 | 61 | 62 | 63 | 64 | 65 | 66 | 67 | 68 | 69 | 70 | 71 |
| C4 | 72 | 73 | 74 | 75 | 76 | 77 | 78 | 79 | 80 | 81 | 82 | 83 |
| C5 | 84 | 85 | 86 | 87 | 88 | 89 | 90 | | | | | |

FIG. 20

METHOD AND APPARATUS FOR CREATING AN AUTOMATIC ACCOMPANIMENT PATTERN ON THE BASIS OF ANALYTIC PARAMETERS

BACKGROUND OF THE INVENTION

The present invention relates generally to automatic accompaniment devices and thier methods applicable to automatic performances such as an automatic bass and automatic chord performance, and more particularly to an improved automatic accompaniment device or method which is capable of freely creating new accompaniment patterns and changing accompaniment patterns in real time in response to actual performance operation by a human operator or user.

In conventional automatic accompaniment devices, a typical technique to obtain automatic accompaniment patterns desired by a user has been to store a plurality of accompaniment patterns in advance in memory and to select any of the prestored accompaniment patterns. However, such a technique has the disadvantage that selectable accompaniment patterns are limited to those prestored in the memory having a limited storage capacity. Due to the limited number of prestored accompaniment patterns in the memory, the user can only select any of the prestored patterns which appears to be closest to the one desired by the user, and thus accompaniment patterns truly desired by the user could often not be obtained.

So, as an approach to allow automatic accompaniment patterns to be formed completely freely as desired by the user, it has been proposed in the art to create desired accompaniment patterns by the user manually playing a keyboard (depressing keys) of an electronic musical instrument or the like and store the created accompaniment patterns in memory, so that an automatic accompaniment can be performed by reproductively reading out any of the stored accompaniment patterns.

Further, to facilitate creation of rhythm performance patterns, it has been proposed to prestore a plurality of patterns for each of several typical percussion instrument sound sources. According to this approach, a desired rhythm performance pattern can be obtained by selecting desired one of the prestored patterns for each of the sound sources and combining the thus-selected patterns.

However, the above-mentioned approach based on the user's manual performance has also the problem that appropriate accompaniment patterns can not be created unless the user has a sufficient knowledge of music as well as a sufficient performance technique. Even if the user has a sufficient knowledge and performance technique, the accompaniment pattern creation according to the approach would take considerable amounts of time and labor and involve very difficult operations.

Further, with the approach based on storing of a plurality of patterns for each of several percussion instrument sound sources, it is necessary to separately make selections of one of the percussion instrument sound sources and of the patterns, which is cumbersome and results in poor operability. Besides, variations attained by combinations the performance patterns are considerably limited and accompaniment patterns can not be created freely, because the selection is only possible from among the patterns stored in the memory.

In addition, automatic accompaniment devices have been known which are designed to switch the accompaniment pattern in accordance with the contents of an actual performance by a player. But, because the accompaniment pattern switching is only among those prestored in memory, performance by such automatic accompaniment devices would undesirably become monotonous.

SUMMARY OF THE INVENTION

It is therefore an object of the present invention to provide an automatic accompaniment pattern generating device and such a method which are capable of freely creating new accompaniment patterns and changing accompaniment patterns in real time in response to actual performance operation by a human operator.

In order to accomplish the above-mentioned object, an automatic accompaniment pattern generating device in accordance with the present invention comprises a parameter supply section for supplying a plurality of parameters including at least one time-varying parameter, and an accompaniment pattern forming section for determining respective note information and sounding timing information of accompaniment tones on the basis of the parameters supplied by the parameter supply section so as to form an accompaniment pattern comprised of the determined note information and sounding timing information.

With the present invention arranged in the above-mentioned manner, any optional accompaniment patterns can be formed or created on the basis of a plurality of parameters, rather than by selecting from existing patterns or by combining phrase patterns. Thus, by changing the values of the parameters to be supplied as necessary, accompaniment patterns can be created in an unconstrained manner. By use of time-varying parameters, an optional accompaniment pattern can be created in such a manner that a desired accompaniment tone is generated or sounded at a desired time point. Further, by changing the value of a parameter or parameters at a desired time point, it is possible to freely change the accompaniment pattern to be formed. As a result, the present invention greatly facilitates creation of new accompaniment patterns and also facilities an operation to complicatedly change an accompaniment pattern in real time.

An automatic accompaniment pattern generating device according to another aspect of the present invention comprises a parameter supply section for supplying a plurality of parameters, a performance operator section, a change section for detecting a performance state of the performance operator section so as to change the parameters supplied by the supply section on the basis of performance states detected at least at a current time and a given past time, and an accompaniment pattern forming section for determining respective note information and sounding timing information of accompaniment tones on the basis of the parameters supplied by the parameter supply section so as to form an accompaniment pattern comprised of the determined note information and sounding timing information, whereby the accompaniment pattern to be formed by the accompaniment pattern forming section is changed in response to a changing real-time performance via the performance operator section.

Assuming that the performance operator section is a keyboard, a real-time performance state of the keyboard can be expressed in measured quantities, with a certain probability, on the basis of correlation between the keyboard performance states detected for a current time and a given past time. Thus, by changing the parameters in accordance with the measured information, parameter control reflecting a changing real-time performance state is permitted, and by forming an accompaniment pattern on the basis of the thus-controlled parameters, the present invention can easily achieve further real-time control of an accompaniment pattern to be formed and complicatedness of the change control.

An automatic accompaniment pattern generating device according to still another aspect of the present invention comprises an input section for inputting performance information to the device, a parameter preparation section for analyzing the performance information inputted by the input section and preparing a parameter in accordance with the analyzed performance information, and an accompaniment pattern forming section for determining respective note information and sounding timing information of accompaniment tones on the basis of the parameter prepared by the parameter preparation section so as to form an accompaniment pattern comprised of the determined note information and sounding timing information.

A performance on a keyboard or the like is analyzed on the basis of performance information inputted in real time in response to actual performance operation thereon, and a parameter is automatically prepared in accordance with the analyzed performance. An optional accompaniment pattern is newly formed on the basis of the thus-prepared parameter. As a result, the present invention can create an accompaniment pattern full of variations and achieve further real-time control of the accompaniment pattern.

An automatic accompaniment pattern generating device according to still another aspect of the present invention comprises a parameter supply section for supplying a plurality of parameters, a performance operator section, a modulation section for modulating at least one of the parameters to be supplied by the parameter supply section in accordance with a performance state of the performance operator section, and an accompaniment pattern forming section for determining respective note information and sounding timing information of accompaniment tones on the basis of the parameter modulated by the modulation section so as to form an accompaniment pattern comprised of the determined note information and sounding timing information, whereby the accompaniment pattern to be formed by the accompaniment pattern forming section is changed in response to a changing real-time performance via the performance operator section. In this case, by modulating at least one of the parameters in response to actuation of a real-time operator such as a modulation wheel, the present invention can effectively facilitate further real-time control and change control of an accompaniment pattern to be generated.

BRIEF DESCRIPTION OF THE DRAWINGS

For better understanding of the above and other features of the present invention, the preferred embodiments of the invention will be described in detail below with reference to the accompanying drawings, in which:

FIGS. 5A and 5B show examples of total coefficient values for use in determining downbeat and upbeat velocities on the basis of a syncopation parameter value, of which FIG. 5A shows total coefficient values for sounding timing of eighth notes and FIG. 5B shows total coefficient values for sounding timing of sixteenth notes;

FIGS. 6A to 6D show examples of tone lists for use in synthesizing a bass pattern;

FIG. 7 is a diagram showing an example of a table for converting a density parameter into a pitch interval;

FIGS. 8A to 8D are diagrams showing examples of selection probability calculating tables for use in synthesizing a chord pattern;

FIG. 9 is a diagram showing examples of rhythm patterns;

FIG. 15 is a diagram showing examples of response state tables;

FIG. 17 is a diagram showing how activity and syncopation parameters in a mimic texture are determined;

FIG. 18A is a diagram showing correspondency between mimic texture parameters and calculated average values of the parameters;

FIG. 18B is a diagram showing correspondency between bass and chord off-set texture parameters and the calculated average values of the parameters;

FIG. 20 is a mapping diagram showing note numbers within a pitch range determined by register and range parameters, in corresponding relations to the individual pitches of the selection probability calculating table of FIG. 8A; and FIG. 21 is a diagram showing a manner in which chord component notes are determined from among a plurality of selected candidate notes.

DETAILED DESCRIPTION OF THE PREFERRED EMBODIMENTS

Figure 1:
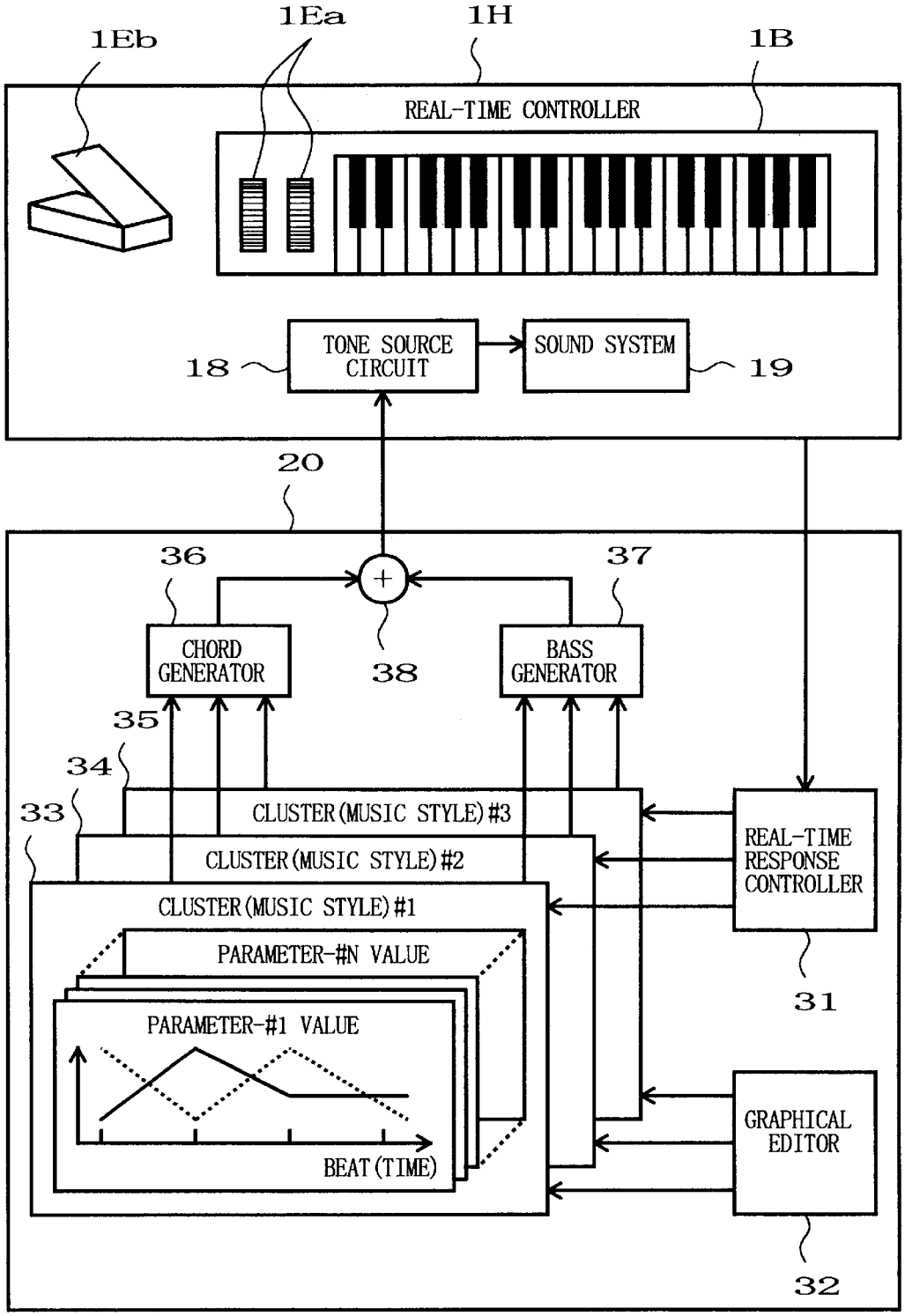
FIG. 1 is a block diagram illustrating a general structure of an automatic accompaniment device incorporating an automatic accompaniment pattern generating device in accordance with an embodiment of the present invention.
Figure 2:
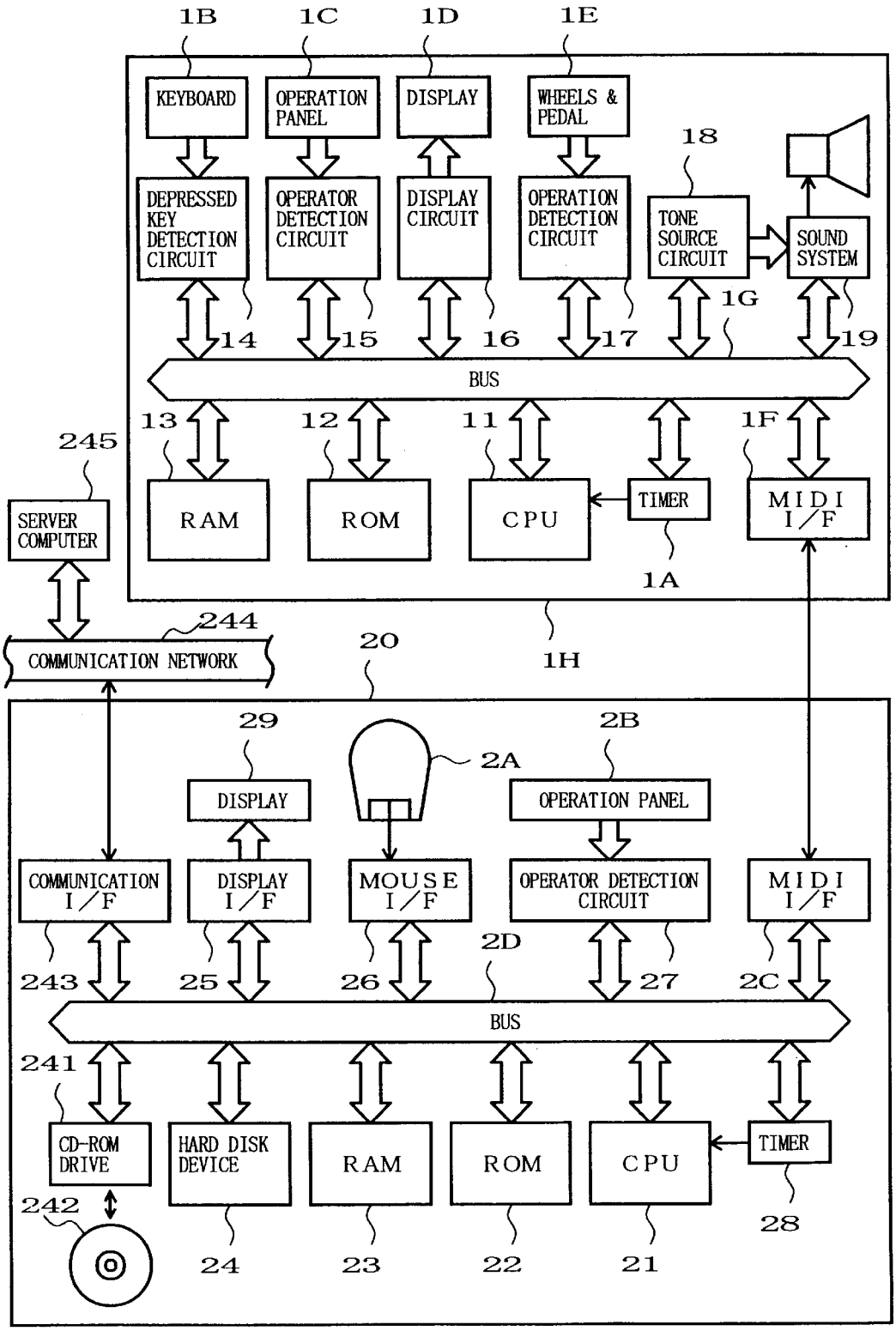
FIG. 2 is a block diagram illustrating a detailed structure of the automatic accompaniment device of FIG. 1.

FIG. 1 is a block diagram illustrating a general structure of an automatic accompaniment device incorporating an automatic accompaniment pattern generating device in accordance with an embodiment of the present invention, and FIG. 2 is a block diagram illustrating a detailed structure of the automatic accompaniment device of FIG. 1.

As shown, the automatic accompaniment device incorporating the accompaniment pattern generating device in accordance with an embodiment of the present invention generally comprises an electronic musical instrument 1H including a keyboard 1B, tone source circuit 18, etc., and a personal computer 20 connected with the musical instrument 1H via MIDI interfaces 1F, 2C. Using a real-time response controller 31, the personal computer 20 analyzes MIDI-form performance data output from the musical instrument 1H in response to a player's operation of any of the keys on the keyboard 1B. The personal computer 20 changes accompaniment pattern forming parameters 33, 34 and 35 in real time on the basis of the analyzed result, and then synthesizes accompaniment patterns (chord and bass patterns) via chord and bass generators 36 and 37 in accordance with the resultant changed parameters, so as to output the synthesized parameter as MIDI-form performance data to the tone source circuit 18 of the musical instrument 1H.

The electronic musical instrument 1H will be described first hereinbelow.

Microprocessor unit or CPU 11 controls the entire operation of the electronic musical instrument 1H. To this CPU 11 are connected, via a bus 1G, a ROM 12, a RAM 13, a depressed key detection circuit 14, an operator detection circuit 15, a display circuit 16, an operation detection circuit 17, a tone source circuit 18, a sound system 19, a timer 1A and a MIDI interface (I/F) IF.

Although the present invention is described here in relation to the electronic musical instrument where depressed key detection, transmission/reception of performance data (note data), tone generation or sounding, etc. are performed by the CPU 11, it may also be applied to another type electronic musical instrument where a module comprising a depressed key detection circuit is provided separately from a module comprising a tone source circuit and where data exchange between the modules is effected via a MIDI interface.

The above-mentioned ROM 12, which is a read-only memory, stores therein various control programs for the CPU 11 and various data.

The RAM 13 is allocated in predetermined address areas of a random access memory for use as various registers and flags for temporarily storing performance information and various data which are produced as the CPU 11 executes the programs.

The keyboard 1B has a plurality of keys for designating the pitch of tone to be generated and key switches provided in corresponding relations to the keys. If necessary, the keyboard 1B may also include key-touch detection means such as a key depression velocity or force detection device. The keyboard 1B is employed here just because it is a fundamental performance operator which is easy for music players to manipulate, but any other suitable performance operator such as drum pads may of course be employed.

The depressed key detection circuit 14, which comprises circuitry including a plurality of key switches corresponding to the keys on the keyboard 1B, outputs key-on event information upon detection of a new depressed key and key-off event information upon detection of a new released key. The depressed key detection circuit 14 also generates key touch data by determining the key depression velocity or force and outputs the generated touch data as velocity data. Each of the key-on and key-off event information and velocity information is expressed on the MIDI standards and contains data indicative of the key code of the depressed or released key and channel to which the key is assigned.

Operation panel 1C comprises a variety of operators or switches for selecting, setting and controlling the color, volume, effect etc. of each tone to be generated. Details of the operation panel 1C will not be described here because they are known to those skilled in the art. The operator detection circuit 15 detects an operational condition of each of the operators to provide operator information corresponding to the detected condition to the CPU 11 via the bus 1G.

The display circuit 16 shows on a display 1D various information such as the controlling conditions of the CPU 11 and contents of setting data, and the display 1D comprises for example a liquid crystal device (LCD) that is controlled by the display circuit 16.

Wheels and pedal 1E are various wheels 1E*a* such as modulation, pitch-bend wheels and foot pedal 1E*b*. The operation detection circuit 17 detects an operated direction and amount of these wheels 1E*a* and an operated amount of the pedal 1E*b* to provide information corresponding to the detected direction and amount to the CPU 11 via the bus 1G.

The tone source circuit 18 has a plurality of tone generation channels, by means of which it is capable of generating plural tones simultaneously. The tone source circuit 18 receives tone control information (data complying with the MIDI standards such as note-on, note-off, velocity and pitch data and tone color number) supplied from the CPU 11 via the bus 1G, and it generates tone signals on the basis of the received data, which is supplied to the sound system 19. The tone generation channels to simultaneously generate a plurality of tone signals may be implemented by using a single circuit on a time-divisional basis or by providing a circuit for each of the channels.

Any tone signal generation method may be used in the tone source circuit 18 depending on an application intended. For example, any conventionally known tone signal generation method may be used such as: the memory readout method where tone waveform sample value data stored in a waveform memory are sequentially read out in accordance with address data that change in correspondence to the pitch of tone to be generated; the FM method where tone waveform sample value data are obtained by performing predetermined frequency modulation operations using the above-mentioned address data as phase angle parameter data; or the AM method where tone waveform sample value data are obtained by performing predetermined amplitude modulation operations using the above-mentioned address data as phase angle parameter. Other than the above-mentioned, the tone source circuit 18 may also use the physical model method where a tone waveform is synthesized by algorithms simulating a tone generation principle of a natural musical instrument; the harmonics synthesis method where a tone waveform is synthesized by adding a plurality of harmonics to a fundamental wave; the formant synthesis method where a tone waveform is synthesized by use of a formant waveform having a specific spectral distribution; or the analog synthesizer method using VCO, VCF and VCA. Further, the tone source circuit 18 may be implemented by use of combination of a DSP and microprograms or of a CPU and software programs, rather than dedicated hardware. Tone signals generated by the tone source circuit 18 are audibly reproduced or sounded via the sound system 19 comprising amplifiers and speakers.

The timer 1A generates clock pulses to count time intervals, etc. and the clock pulses are given to the CPU 11 as interrupt instructions, in response to which the CPU 11 performs various processes as timer interrupt processes.

The MIDI interface IF interconnects the bus 1G of the electronic musical instrument 1H and a MIDI interface 2C of the personal computer 20, and the personal computer MIDI interface 2C interconnects a bus 2D of the personal computer 20 and the MIDI interface 1F of the musical instrument 1H. Thus, the musical instrument's bus 1G and computer's bus 2D are interconnected via the MIDI interfaces 1F and 2C so that data complying with the MIDI standards can be exchanged bidirectionally between the instrument 1H and computer 20.

Next, the structure of the personal computer 20 will be described.

Microprocessor unit or CPU 21 controls the entire operation of the personal computer 20. To this CPU 21 are connected, via the bus 2D, a ROM 22, a RAM 23, a hard disk device 24, a CD-ROM (Compact Disc Read Only Memory) drive 241, a communication interface 243, a display interface (I/F) 25, a mouse interface 26, an operator detection circuit 27, a timer 28 and a MIDI interface 2C.

The above-mentioned ROM 22, which is a read-only memory, stores therein various control programs for the CPU 21 and various data including data representing marks and letters. The RAM 23 is allocated in predetermined address areas of a random access memory for temporarily storing various data which are produced as the CPU 21 executes the programs.

The hard disk device 24 is an external storage device of the personal computer 20 which preferably has a capacity of hundreds of megabytes to several gigabytes. In this embodiment, the hard disk device 24 stores therein a real-time response control program for creating an accompaniment pattern in real time and a characteristic extracting program for synthesizing an accompaniment pattern and also stores therein, as a data base, groups of various parameters to be used during execution of these programs. The personal computer 20 also operates as the chord generator 36 or bass generator 37 as dictated by the real-time response control program, or operates as the real-time response controller 31 as dictated by the characteristic extracting program. Details of the various parameters to be used during execution of these programs will be described later in detail.

Although not specifically shown in the drawings, there may also be provided a cache memory (RAM) having a capacity of for example several megabytes in order to substantially reduce necessary times for accessing the hard disk device 24, or a DMA (direct memory access) device to lessen a load in transferring data between the RAM 23 and hard disk device 24.

The CD-ROM drive 241 can read out programs and/or data from a CD-ROM 242 storing them therein. In the case that the hard disk device 24 has not yet stored therein the above real-time response control program, characteristic extracting program and groups of various parameters in a initial stage, the programs and parameters can be read out by the CD-ROM drive 241 from the CD-ROM 242 storing them therein and are installed in the hard disk device 24 so that the CPU 21 can execute and use the installed programs and parameters. In order to install the programs and parameters in the hard disk device 24, other external storage media than the CD-ROM, like a floppy disk or a MO (Magneto-Optical) disk, may be utilized instead of the CD-ROM.

The communication interface 243 is connected to a communication network 244 like a LAN (Local Area Network), the Internet or a telephone network and is further connected to a server computer 245 through the communication network 244.

In the case that the hard disk device 24 has not yet stored therein the above programs and parameters, the personal computer 20 can down-load the programs and parameters from the server computer 245, which is storing the programs and parameters therein, through the communication network 244. The personal computer 20, as a client, requests a down-load of the programs and parameters to the server computer 245 through the communication network 244. The server computer 245 send the requested programs and parameters to the personal computer 20 in response to the client's request. The personal computer 20 stores the sent programs and parameters into the hard disk device 24. Then, the personal computer 20 comes to be able to execute and/or use the programs and parameters.

Display 29 displays, for visual recognition by a human operator or user, data having undergone arithmetic operations in the personal computer 20 and received via a display interface (IF) 25, and it typically comprises a conventional CRT or LCD. Mouse 2A is a pointing device to input desired coordinates on the display 29, and the output signal from the mouse 2A is passed to the CPU 21 via the mouse interface 26 and bus 2D.

Operation panel 2B comprises a keyboard for inputting a program and data to the personal computer 20, which includes ten-keys and function keys. The operator detection circuit 27 detects an operational state of each of the keys on the operation panel 2B, so as to output key information corresponding to the detected state to the CPU 21 via the bus 2D.

The above-mentioned display 29, mouse 2A and operation panel 2B together constitute a GUI (graphical user interface). In the illustrated example of FIG. 1, the GUI works as a graphical editor 32 for modifying various parameters during creation of an accompaniment pattern. By operating this graphical editor 32, a human operator or user can apply desired modifications to the parameters.

Timer 28 generates clock pulses to count time intervals and control the entire personal computer 20, and the computer 20 counts a predetermined time by counting the clock pulses and performs an interrupt process in response to the counted time. For example, by setting a predetermined number of the pulses to correspond to an automatic accompaniment tempo, the personal computer 20 will perform an automatic accompaniment process in accordance with that tempo.

Figure 3:
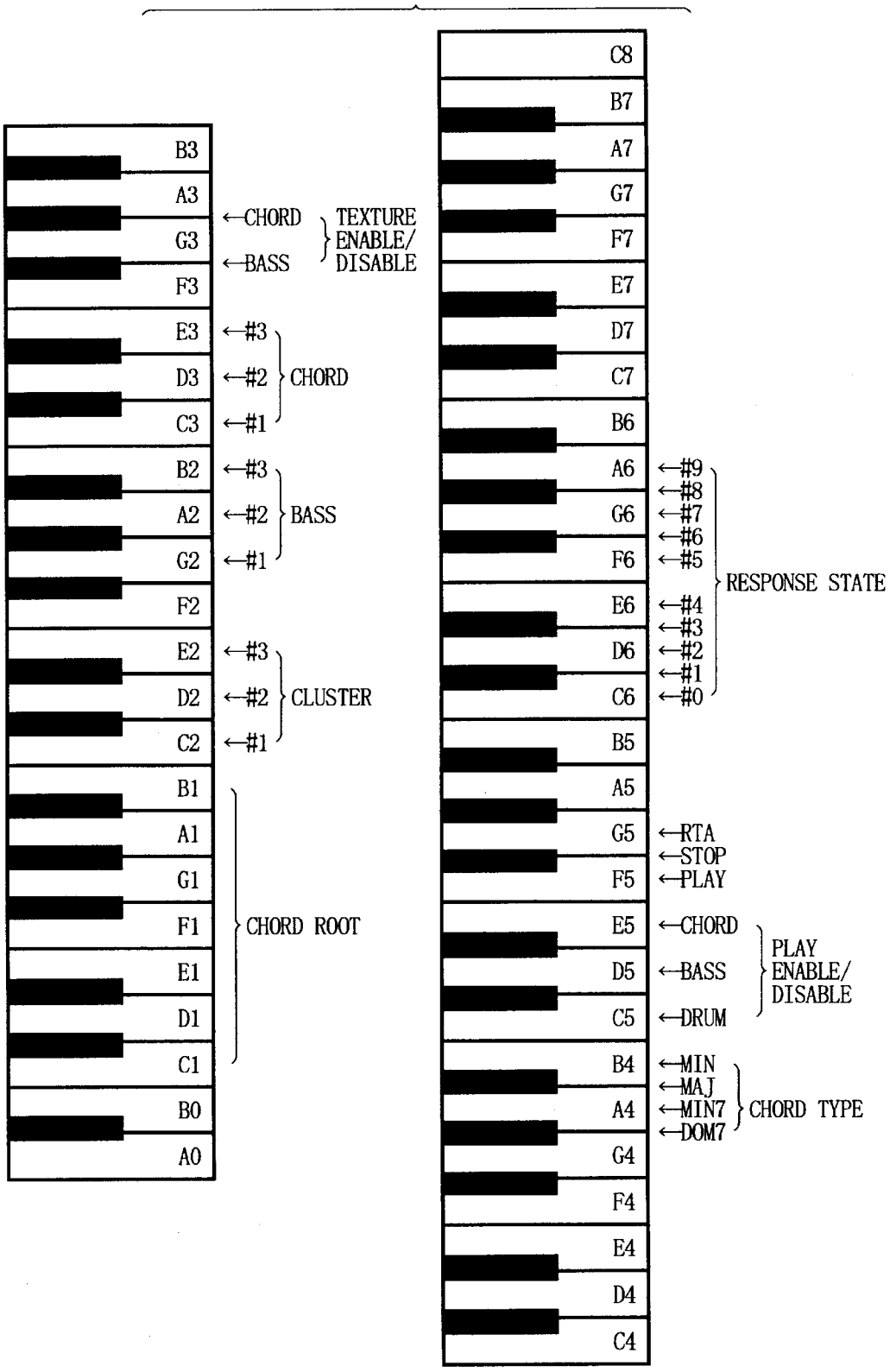
FIG. 3 is a diagram illustrating examples of switch functions allocated to keys of a keyboard of FIG. 1.

In this embodiment, the keyboard 1B is used, in addition to the mouse 2A and operation panel 2B, as an operator for selecting and setting various functions of the personal computer 20. Namely, as shown in FIG. 3, various switch functions are allocated to the keyboard 1B so that the personal computer 20 operates on the basis of a note-on event caused by depression of a key on the keyboard 1B as when a switch event occurs. However, when a keyboard key is depressed with the pedal 1E*b* depressed, the personal computer 20 performs normal tone generating or deadening operation except for a specific key range, as will be later described in detail. Alphanumerics written on the white keys in the figure represent the respective codes of the keys or key codes.

In the example of FIG. 3, the keyboard 1B has a total of 88 keys, from key code A0 to key code C8, and the keys of one octave from key code C1 to key code B1 are each set to work as a switch for designating a chord root. For example, when the key of key code F1 is depressed, the electronic musical instrument 1H provides the personal computer 20 with MIDI data corresponding to the depressed key, so that the computer 20 performs an automatic performance after changing "F" into a chord root.

The keys of key codes C2, D2 and E2 are each set to work as a switch for designating a different cluster. Namely, the "C2", "D2" and "E2" keys work as switches for designating a first cluster (cluster #1), second cluster (cluster #2) and third cluster (cluster #3), respectively. The term "cluster" as used herein means a performance style (music style). This embodiment is described here in connection with a case where three different clusters are involved; however, the number of such clusters may of course be more than three. Each of the clusters includes three kinds of bass-pattern-creating bass textures and three kinds of chord-pattern-creating chord textures.

Further, the keys of key codes G2, A2 and B2 are each set to work as a switch for selectively instructing which one of the three bass textures of the cluster instructed by the "C2", "D2" or "E2" key should be used. Namely, the "G2", "A2" and "B2" keys work as switches for designating a first bass texture (bass #1), second bass texture (bass #2) and third bass texture (bass #3), respectively. Each of the bass texture is a group of parameters for creating a bass pattern, as will be later described.

Further, the keys of key codes C3, D3 and E3 are each set to work as a switch for selectively indicating which one of the three chord textures of the cluster designated by the "C2", "D2" or "E2" key should be used. Namely, the "C3", "D3" and "E3" keys work as switches for designating a first chord texture (chord #1), second chord texture (chord #2) and third chord texture (chord #3), respectively. Each of the chord texture is a group of parameters for creating a chord pattern, as will be later described.

The key of key code F#3 is set to work as a switch for indicating whether or not any of the base textures is to be used to create or form a bass pattern, i.e., whether to enable or disable the base textures, and the key of key code G#3 is set to work as a switch for indicating whether or not any of the chord textures is to be used to create or form a chord pattern, i.e., whether to enable or disable the chord textures.

Further, the keys of key codes G#4 to B4 are each set to work as a switch for designating a chord type: the "G#4" key works as a switch for designating a dominant 7th (dom7), "A4" key for designating a minor 7th (min7), "A#4" for designating a major (maj), and "B4" key for designating a minor (min).

The key of key code C5 is set to work as a switch for instructing enable or disable of a drum performance process, the key of key code D5 for instructing enable or disable of a bass performance process, and the key of key code E5 for instructing enable or disable of a chord performance process. The key of key code F5 is set to work as a switch for instructing a start of an automatic performance, while the key of key code F#5 is set to work as a switch for instructing a stop of an automatic performance.

Further, the key of key code G5 is set to work as a switch for instructing enable or disable of the real-time response controller 31 of FIG. 1. That is, when the "G5" key is depressed, a real-time response flag RTA is set to an "ON" state so that the real-time response controller 31 is enabled. The real-time response flag RTA is also set to an "ON" state when the foot pedal 1E*b* is depressed. The keys of key codes C6 to A6 are each set to work as a switch for, when the keyboard 1B is operated, instructing how the real-time response controller 31 should respond to the keyboard operation to modify the parameters. Although this embodiment is described in connection with a case where the controller 31 can respond to the keyboard operation in nine different ways, i.e., the controller 31 can assume nine kinds of response conditions, the number of kinds of response conditions may of course be other than nine. Details of processing based on the operation of these keys will be given later.

All the keys, except for the chord root designating keys C1 to B1 and response condition instructing keys C6 to A6, work as keys for a normal performance, when they are operated with pedal 1E*b* depressed.

Now, a description will be made about parameters stored in the hard disk device 24 of the personal computer 20.

In the hard disk device 24, there are stored, for each of the clusters, parameters to be used for creating a chord pattern (i.e., chord textures) and parameters to be used for creating a bass pattern (i.e., bass textures). These parameters relate to music information that is necessary and sufficient for reproducing or synthesizing an accompaniment pattern.

Each of the chord textures includes an activity parameter, syncopation parameter, volume parameter, duplet/triplet parameter, duration parameter, range parameter, sub-range parameter, register parameter, number-of-notes ("num notes" in the drawings) parameter, density parameter, color-a parameter and color-b parameter. On the other hand, each of the bass textures includes an activity parameter, syncopation parameter, volume parameter, duplet/triplet parameter, scale duration parameter, chord tone parameter, ripe tone parameter, dull tone parameter, direction parameter and leaper parameter.

The data structure of each of the above-mentioned parameters will be described below.

FIG. 4 is a diagram showing examples of parameters constituting the chord texture and bass texture. In the figure, "CHORD PATCH 28" represents a chord voice (tone color) number of the chord texture, "BASS PATCH 32" represents a bass voice (tone color) number of the bass texture, and "TEMPO: 90" indicates that the tempo value for the two textures is 90. The tempo value is the number of beats per minute measured as by a metronome.

"CHORD" indicates that data following this are parameters relating to a chord, and "BEATS 4" indicates that the chord texture is of quadruple time. In FIG. 4, the duration, register, number-of-notes, activity, volume, range, sub-range, density and syncopation parameters are listed as the chord relating parameters. Each of these parameters is comprised of a predetermined symbol of the parameter and following sets of slot numbers and numerical values. The slot number represents a time-axis position in a measure. Thus, for example, in the case of quadruple time, the time slot represents one of time points defined by dividing a measure by 96 (or dividing a beat by 24), and in the case of three time, the time slot represents one of time points defined by dividing a measure by 72. Each of the parameters can take values ranging from "0" to "127".

In the case of "DURATION (0, 21) (96, 21)", the letters "DURATION" is a parameter symbol, the first values "0" and "96" in two sets of parentheses are slot numbers, and the second value "21" in the two sets of parentheses is a parameter value for the slot number. When two slot numbers "0" and "96" are specified with a same parameter value as in the duration parameter, it means that the parameter value (in the example, "21") does not change at all in the measure. In the illustrated example of FIG. 4, each of the register, number-of-notes, volume, range, sub-range and density parameters specifies a constant parameter value which does not change in a measure, similarly to the duration parameter.

Figures 4A, 4B:
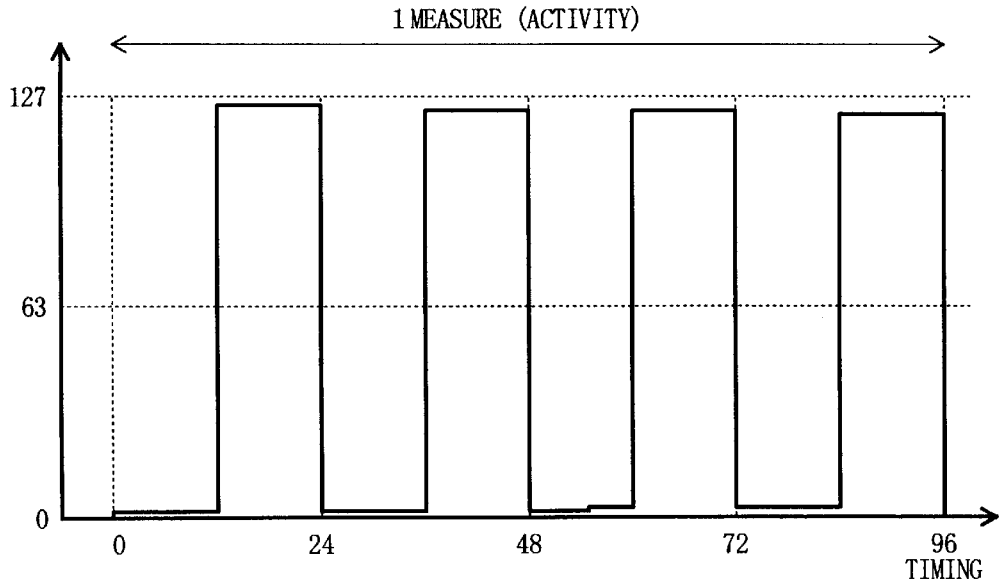
FIG. 4 is a diagram illustrating examples of various parameters constituting chord and bass textures.

In contrast, the activity parameter, syncopation parameter, etc. include three or more slot numbers, and the three or more slot numbers mean that the parameter value changes in a measure. FIG. 4B shows how the activity parameter value of one of the chord textures changes in a measure. As mentioned, some of the parameters change in value over time, while others do not change in value over time.

"BASS" indicates that data following this are parameters relating to bass. In FIG. 4, dull tone, activity, volume, leaper, chord tone, syncopation and direction parameters are listed as the bass relating parameters. Each of the bass relating parameters is constructed similarly to the above-mentioned chord texture parameters. It should be noted that those parameters not included in the chord texture (such as the duplet/triplet, color-a and color-b parameters) and not included in the bass texture (such as duplet/triplet, scale duration and ripe tone parameters) are treated as having a value of "0".

The musical meaning of each of the above-mentioned parameters is as follows.

First, a description will be made about the activity parameter, syncopation parameter, volume parameter and duplet/triplet parameter which are common to the chord and bass textures. Each of these parameters is set to a value ranging from "0" to "127".

The activity parameter is a parameter relating to resolution of event occurrence (tone generating resolution). More specifically, the activity parameter is a parameter that, depending on its value, determines which of notes ranging from quarter note to sixteenth note is to be sounded, or whether no note is to be sounded at all (no sounding). The activity parameter indicates "no sounding" when it's value is "0". When the value is between "1" and "63", the activity parameter determines whether a quarter note or a sixteenth note is to be sounded depending on the magnitude of the value: more specifically, the smaller the parameter value, the higher is the probability of a quarter note being sounded, and the greater the parameter value, the higher is the probability of an eighth note being sounded. When the value is between "64" and "126", the activity parameter determines whether an eighth note or a sixteenth note is to be sounded depending on the magnitude of the value: more specifically, the smaller the parameter value, the higher is the probability of an eighth note being sounded, and the greater the parameter value, the higher is the probability of a sixteenth note being sounded. When the value is "127", the activity parameter indicates that a sixteenth note is to be sounded.

The syncopation parameter is a parameter that determines a velocity of each note on the basis of the tone generating resolution determined by the activity parameter. When the value is not greater than "63", the syncopation parameter operates in such a manner that downbeat velocity is greater than upbeat velocity. When the value is equal to or greater than "64", the syncopation parameter operates in such a manner that downbeat velocity is smaller than upbeat velocity.

FIGS. 5A and 5B show examples of total coefficient values for use in determining downbeat and upbeat velocities on the basis of the syncopation parameter value. FIG. 5A shows total coefficient values of tone generation or sounding timing of eighth notes, for syncopation values "0", "31", "63 or 64", "95" and "127", in the case where the activity parameter value in a measure is "63 or 64" and it has been decided that all tones are to be generated in a measure in eight note. Slot numbers, which are shown in the figure as tone generating timing, are the same as the above-mentioned time point in a measure. Slot numbers "0", "24", "48" and "72" correspond to downbeats and slot numbers "12", "36", "60" and "84" correspond to upbeats in the case where all tones are to be generated in a measure in eight note.

In FIGS. 5A and 5B, when the syncopation parameter value is "0", the total coefficient value of each downbeat is "15" and the total coefficient value of each upbeat is "0", and when the syncopation parameter value is "127", the total coefficient value of each downbeat is "−15" and the total coefficient value of each upbeat is "20". When the syncopation parameter value is between "1" and "126", each downbeat and each upbeat take a total coefficient value that is obtained by linearly interpolating between the above-mentioned extreme syncopation values "0" and "127". Namely, when the syncopation parameter value is "31", the total coefficient value of each downbeat is "7.5" and the total coefficient value of each upbeat is "5"; when the syncopation parameter value is "63 or 64", the total coefficient value of each downbeat is "0" and the total coefficient value of each upbeat is "10"; when the syncopation parameter value is "95", the total coefficient value of each downbeat is "−7.5" and the total coefficient value of each upbeat is "15".

Because the total coefficient value is determined from the syncopation value in the above-mentioned manner, a velocity value can be calculated by substituting the total coefficient value into the following equation:

$$\text{Velocity}=(\text{volume value}-64)+\text{total coefficient value}\times 3,$$

where the volume value is a value of the volume parameter. Thus, the velocity of each downbeat and upbeat can be obtained. In the event that the velocity value obtained by substituting the total coefficient value into the above equation is a negative value, it will be treated as "0", and in the event that the thus-obtained velocity value is more than "127", it will be treated as "127".

Further, FIG. 5B shows total coefficient values of tone generation or sounding timing of sixteenth notes, for syncopation values "0", "31", "63 or 64", "95" and "127", in the case where the activity parameter value in a measure is "127" and it has been decided that all tones are to be generated in a measure in eighteenth note.

The duplet/triplet parameter is a parameter indicating whether an even number or odd number of tones are to be generated: each duplet/triplet parameter value between "0" and "63" indicates that an even-number of tones are to be generated and each duplet/triplet parameter value between "64" and "127" indicates that an odd-number of tones are to be generated. Therefore, if the activity parameter value is "63 or 64" and the duplet/triplet parameter value is between "64" and "127", an eighth-note triplet will be selected, and if the activity parameter value is "127" and the duplet/triplet parameter value is between "64" and "127", a sixteenth-note triplet will be selected.

Next, a description will be made about the scale duration parameter, direction parameter, leaper parameter, chord tone parameter, ripe tone parameter and dull tone parameter which are peculiar to the bass texture. These parameters operate to determine a bass pattern and are constructed in the following manner. These parameters are also set to a value within a range from "0" to "127".

The scale duration parameter is for determining duration of a bass pattern in accordance with the activity parameter value, and it is set to a value within a range from "0" to "127". When the scale duration parameter value is "0", it is treated differently from when it is other than "0". If the scale duration parameter value is "0" and the activity parameter value is between "0" and "63", duration of a bass pattern is determined by the following equation:

$$12.5\times 2.4/\text{tempo}$$

In this case, if the tempo value is "90", the duration will be 0.33 sec.

If the scale duration parameter value is "0" and the activity parameter value is between "64" and "127", duration of a bass pattern is determined by $$12.5\times1.6/\text{tempo}$$

In this case, if the tempo value is "90", the duration will be 0.22 sec.

When the scale duration parameter value is other than "0", the duration is determined by multiplying the above equation by $(5^m-1)$, where "m" is a value obtained by dividing the scale parameter value by "100". Namely, if the scale duration parameter value is other than "0" and the activity parameter value is between "0" and "63", duration of a bass pattern is determined by $$(5^m-1)\times12.5\times2.4/\text{tempo}$$

If the scale duration parameter value is other than "0" and the activity parameter value is between "64" and "127", duration of a bass pattern is determined by $$(5^m-1)12.5\times1.6/\text{tempo}$$

The direction parameter is a parameter that determines whether a tone to be generated should be higher or lower in pitch than an immediately preceding tone in a last-determined bass pattern. When the direction parameter is of a value between "0" and "63", the pitch of the tone to be generated is selected to be lower than that of the preceding tone, whereas when the direction parameter is of a value between "64" and "127", the pitch of the tone to be generated is selected to be higher than that of the preceding tone.

The leaper parameter is a parameter that determines a minimum pitch changing width (leap size) of the pitch to be selected in accordance with the pitch changing direction determined by the direction parameter. According to the embodiment, when the leaper parameter is of a value between "0" and "20", the leap size is "one semitone", and when the leaper parameter is of a value between "21" and "40", the leap size is "0". When the leaper parameter is of a value between "41" and "127", the leap size is determined by $$(\text{leaper parameter}-40)/7$$

Decimals of the calculated result are omitted. Consequently, when the leaper parameter value is between "41" and "46", the leap size is "0"; when the leaper parameter value is between "47" and "53", the leap size is one semitone; and when the leaper parameter value is between "54" and "60", the leap size is two semitones. In a similar manner, the leap size will vary as the leaper parameter value changes. Ultimately, when the leaper parameter is "127", the leap size is 12 semitones (one octave).

The chord tone parameter, ripe tone parameter and dull tone parameter determine a tone pitch, by means of associated tone lists, in probability corresponding to the respective values. Namely, assuming that the chord tone, ripe tone and dull tone parameters are of values CT, RT and DT, respectively, then the probability of a chord tone being selected will be CT/(CT+RT+DT), the probability of a ripe tone being selected will be RT/(CT+RT+DT), and the probability of a dull tone being selected will be DT/(CT+RT+DT).

FIGS. 6A to 6D show examples of tone lists for use in synthesizing a bass pattern. The tone lists of FIGS. 6A, 6B, 6C and 6D correspond to a major chord having tonic "C" as its root, a minor chord, a minor 7th chord and a dominant 7th chord, respectively. In the embodiment, one of these tone lists is selectable in response to actuation of one of the keys of key codes C1 to B1 (i.e., switches for designating a chord root) and one of the keys of key codes G#4 to B4 (i.e., switches for designating a chord type). More specifically, the tone list of FIG. 6A is selected by depressing the keys of key codes C1 and A#4; the tone list of FIG. 6B is selected by depressing the keys of key codes C1 and B4; the tone list of FIG. 6C is selected by depressing the keys of key codes C1 and A4; and the tone list of FIG. 6D is selected by depressing the keys of key codes C1 and G#4. As seen from the tone lists of FIGS. 6A to 6D, chord tones are components notes of a selected chord type, dull tones are scale component tones other than the chord tones of the selected chord type, and ripe tones are scale component tones other than the chord and dull tones of the selected chord type. Although only four specific types of chords are shown in the figure, other chord types may be additionally provided for the above-mentioned purposes.

In accordance with the values of the direction, leap size, chord tone, ripe tone and dull tone parameters and selected tone list, a tone pitch is sequentially determined in the following manner. Namely, with respective probabilities proportional to the values of the chord tone, ripe tone and dull tone parameters, tone pitches are selected which are apart from a preceding tone in the selected tone list in a direction determined by the direction parameter and by an interval not smaller than the minimum pitch changing width (leap size) indicated by the leaper parameter and which are closest to the preceding tone.

If the preceding tone is of key code C3, the values of the direction parameter, leaper parameter, chord tone parameter CT and dull tone parameter DT are "113", "10", "84" and "3", respectively, as shown in FIG. 4, and the selected tone list is that of FIG. 6A, chord tone "E3" and dull tone "D3" higher in pitch than the preceding tone key code "C3" by one semitone will be selected with respective probabilities of $^{84}/_{87}$ and $^{3}/_{87}$ as next pitches. Because no ripe tone parameter RT is present, it will be treated as a value "0".

Next, a description will be made about the duration parameter, number-of-notes parameter, register parameter, range parameter, sub-range parameter, density parameter, color-a parameter and color-b parameter that are peculiar to the chord texture. These parameters operate to determine a chord pattern and are constructed in the following manner. These parameters are also set to a value within a range from "0" to "127".

The duration parameter is a duration designating parameter for the chord generator 36, which determines duration of a chord pattern in accordance with the activity parameter value. The duration parameter is set to a value between "0" and "127". Duration of a chord is determined by the same arithmetic expression as that used for the scale duration parameter.

The number-of-notes parameter is a parameter that determines the number of component notes of a chord, i.e., how many tones are to be sounded simultaneously in the chord. The number of tones to be simultaneously generated can be obtained by multiplying the number-of-notes parameter value by $^{10}/_{127}$. Thus, if the number-of-notes parameter value is not greater than "12", the number of tones to be simultaneously generated will be "0"; if the number-of-notes parameter value is between "13" and "26", the number of tones to be simultaneously generated will be "1", and if the number-of-notes parameter value is "127", the number of tones to be simultaneously generated will be a maximum of "10". In the chord texture of FIG. 4, the number-of-notes parameter value is "124", and hence the number of tones to be simultaneously generated is "9".

The register parameter is a parameter that indicates a virtually central pitch of pitches forming a chord and designated by a note number. The range parameter is a parameter that indicates a pitch range of a chord, and thus a pitch range of chord component tones to be generated is determined by the register and range parameters. The thus-determined pitch range extends, over a scope corresponding to one half of the range parameter value, above and below the register parameter value. For example, for the chord texture of FIG. 4, the register parameter value is "60", i.e., "C3" and the range parameter value is "60", a pitch range of tones to be generated will be from "30" (key code F#0) to "90" (key code F#5). Decimals resulting from the calculations are omitted in the embodiment.

The sub-range parameter is a parameter that is designated by a note number and determines, from the pitch range determined on the basis of the register and range parameters, a pitch range of tones to be used as chord component tones. In the chord texture of FIG. 4, the sub-range parameter value is "45" (key code "A1"), and hence tones in the neighborhood of key code A1 are determined as chord component tones.

The density parameter is a parameter that determines a pitch interval in the case where a plurality of tones are generated at the same timing (slot). The density parameter value is converted into a pitch interval by use of a converting table as shown in FIG. 7, which table is set in such a manner that wider pitch intervals are provided for lower-pitch tones (i.e., smaller pitch intervals are provided for higher-pitch tones). In the example of FIG. 7, the maximum pitch interval value is "12" (i.e., one octave), and for density values "17" to "31", "33" to "63" and "65" to "126" not contained in the table, respective pitch intervals are calculated by linear interpolation. Similarly, for note numbers not contained in the table, respective pitch intervals are calculated by linear interpolation.

Each of the color-a and color-b parameters is a parameter to extract, from the pitch range determined by the range parameter, candidate chord component tones on the basis of a selection probability calculating table provided for each of the chord types. Each of the color-a and color-b parameters, which is set to a value between "0" and "127", is used in a later-described arithmetic expression after its value having been multiplied by 1/127 so as to be normalized to a range from "0" to "1".

FIGS. 8A to 8D show examples of the selection probability calculating tables. The tables of FIGS. 8A, 8B, 8C and 8D correspond to a major chord having tonic "C" as its root, a minor chord, a minor 7th chord and a dominant 7th chord, respectively. In the embodiment, one of these tables is selectable in response to actuation of one of the keys of key codes C1 to B1 (i.e., switches for designating a chord root) and one of the keys of key codes G#4 to B4 (i.e., switches for designating a chord type). Each of the selection probability calculating tables contains three levels or groups of 12 pitches covering one octave. The first-level pitches correspond to the chord tones in the tone lists of FIG. 6 and are weighted by first level coefficient REQUIRED at the time of selection probability calculation. The second-level and third-level pitches are pitches designated by the first-level pitches or other pitches. The second-level and third-level pitches are weighted by second level coefficient OPTIONAL 1 and OPTIONAL 2, respectively, at the time of selection probability calculation.

Respective selection probabilities of the 12 tones of the individual levels can be determined by substituting the values of the color-a and color-b parameters and the individual coefficients REQUIRED, OPTIONAL 1 and OPTIONAL 2 into the following arithmetic expression:

$$CA\times((O1\times CT+O2\times(1-CT))+(1-CA)\times RQ,$$

where CA represents a total of the values of the color-a and color-b parameters and is a value common to the 12 tones of each level, RQ is the value of first level coefficient REQUIRED, O1 is the value of second level coefficient OPTIONAL 1, and O2 is the value of third level coefficient OPTIONAL 2. CT is "(−0.6931472×color-b parameter value/color-a parameter value)"th power of a natural logarithm "e"; however, in the embodiment, when the color-a parameter value is "0", CT is treated as "0".

FIG. 9 shows examples of rhythm patterns. A plurality (n) of the rhythm patterns from pattern number #0 to pattern number #n are prestored so that any desired one of them is selectable by the user. Each of the rhythm patterns includes data following the letters "SCORE", and each of the data is comprised of a rhythm time indicative of one of 1920 points divided from a single measure in the case of quadruple time, i.e., time-axis timing, a flag indicative of the content of the data, and a data group corresponding to the flag. In the described embodiment, each of the rhythm patterns includes data identified by three flags "MESSAGE", "NOTE" and "REPEAT".

The data identified by flag "MESSAGE" are each index data indicative of the beginning of a beat in a measure, which are shown in the figure as "0(MESSAGE 10)", "480(MESSAGE 20)", etc. The leading numerical value "0", "480" or the like corresponds to the beginning timing of the beat, the first numerical value "1", "2" or the like after the flag indicates an identification number of the beat, and the last numerical value "0" indicates an output port. In this embodiment, a beat beginning interrupt signal is output on the basis of the flag "MESSAGE", and to achieve this, the flag "MESSAGE" is inserted in the rhythm pattern at time point "0" corresponding to the beginning position of a first beat, time point "480" corresponding to the beginning position of a second beat, time point, "960" corresponding to the beginning position of a third beat, and time point "1440" corresponding to the beginning position of a fourth beat.

The data identified by flag "NOTE" are each data relating to an note-on event, which are shown in the figure, for example, as "0(NOTE 36 84 77 9 0)". The leading numerical value "0" indicates a point along the time axis, and the flag "NOTE" indicates that the data identified thereby is data relating to a drum tone color. The first numerical value "36" after the flag indicates a key number of a drum tone color in GM (General MIDI), the second numerical value "84" indicates velocity, the third numerical value "77" indicates duration, the fourth numerical value "9" indicates a MIDI channel number, and the last numerical value "0" indicates an output port. The data identified by flag "REPEAT" of each rhythm pattern is data relating to a repeating position of the pattern, which is shown in the figure, for example, as "1920(REPEAT 1 T 0)". The leading numerical value "1920" indicates a point along the time axis, and the flag "REPEAT" indicates that the data identified thereby is data relating to repetition of the rhythm pattern. The alphanumerics "1", "T" and "0" relate to a repetition process.

A plurality of the rhythm patterns as shown in FIG. 9 are stored in the hard disk device 24 so that any of the patterns corresponding to a current state of performance executed by the player is selected to be sent to the electronic musical instrument 1H. It should be understood that the above-described arithmetic expressions are just illustrative and other arithmetic expressions may be used to implement the present invention.

Figure 10A:
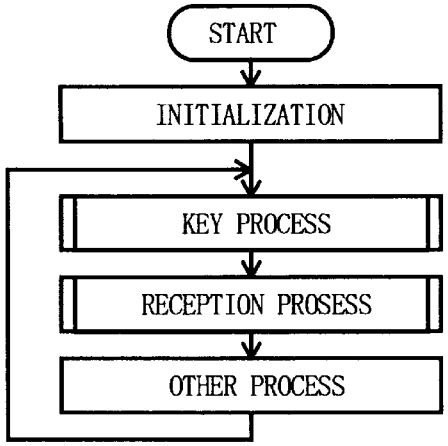
FIG. 10A is a flowchart illustrating an example of a main routine performed by a CPU of an electronic musical instrument of FIG. 1.

Now, a description will be made about examples of various processes performed by the CPU 11 in the electronic musical instrument 1H of FIG. 1. FIG. 10A is a flowchart illustrating an example of a main routine performed by the CPU 11.

Upon power-on, the CPU 11 starts performing processes in accordance with the control program stored in the ROM 12. In an initialization process, various registers and flags in the RAM 13 are set to the respective predetermined intial values or conditions. After the initialization process, the CPU 11 repetitively performs a key process, MIDI reception process and other process in response to occurrence of events in a cyclic fashion.

Figure 10B:
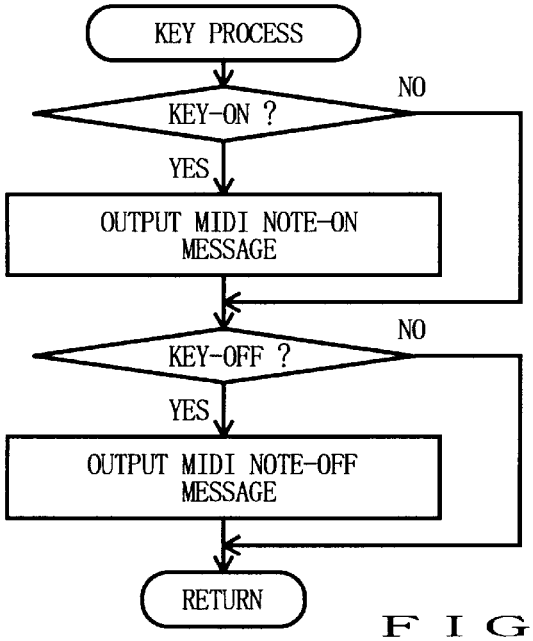
FIG. 10B is a flowchart illustrating an example of a key process of FIG. 10A.

FIG. 10B is a flowchart illustrating an example of the key process of FIG. 10A. In this key process, it is determined whether the keyboard 1A is in a key-on state or key-off state, and depending on the determination result, a MIDI note-on message or MIDI note-off message is output to the personal computer 20 via the MIDI interfaces 1F and 2C. For this purpose, the described embodiment is designed in such a manner that no processing of the electronic musical instrument 1H itself, i.e., the tone source circuit 18 is triggered even when the keyboard 1A is operated; that is, the tone source circuit 18 is prevented from performing any tone generating process during the key process.

Figure 10C:
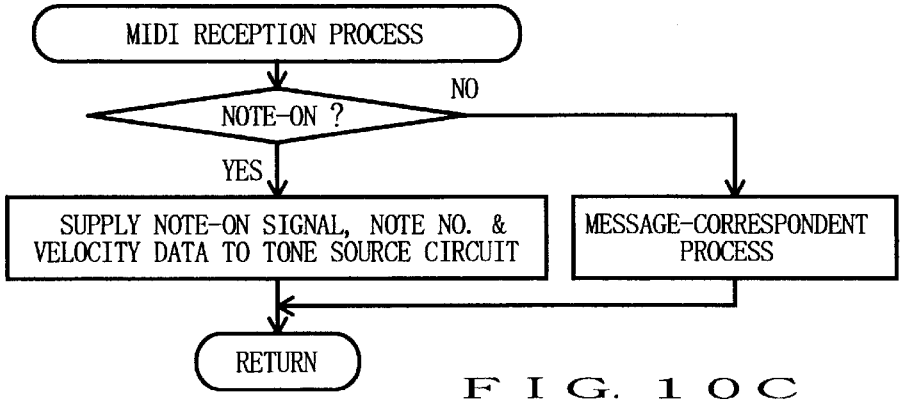
FIG. 10C is a flowchart illustrating an example of a MIDI reception process of FIG. 10A.

FIG. 10C is a flowchart illustrating an example of the MIDI reception of FIG. 10A. This MIDI reception process is performed each time a MIDI message is received from the personal computer 20 via the MIDI interfaces 2C and 1F. In the MIDI reception process, a determination is made as to whether the MIDI message is a note-on message or note-off message. If it is a note-on message (YES), a corresponding note-on signal, note number and velocity are sent to the tone source circuit 18, which in turn generates a tone. If, however, if the MIDI message is other than a note-on message, the CPU 11 returns to the main routine of FIG. 10A after performing a process corresponding to the type of the MIDI message received.

In the other process, there are performed various operations, for example, in response to actuation of any of the operators on the operation panel 1C, the wheels and pedal 1E.

Next, a description will be made about examples of various processes performed by the CPU 21 in the personal computer 20 of FIG. 1, with reference to FIGS. 11 to 21.

Figure 11:
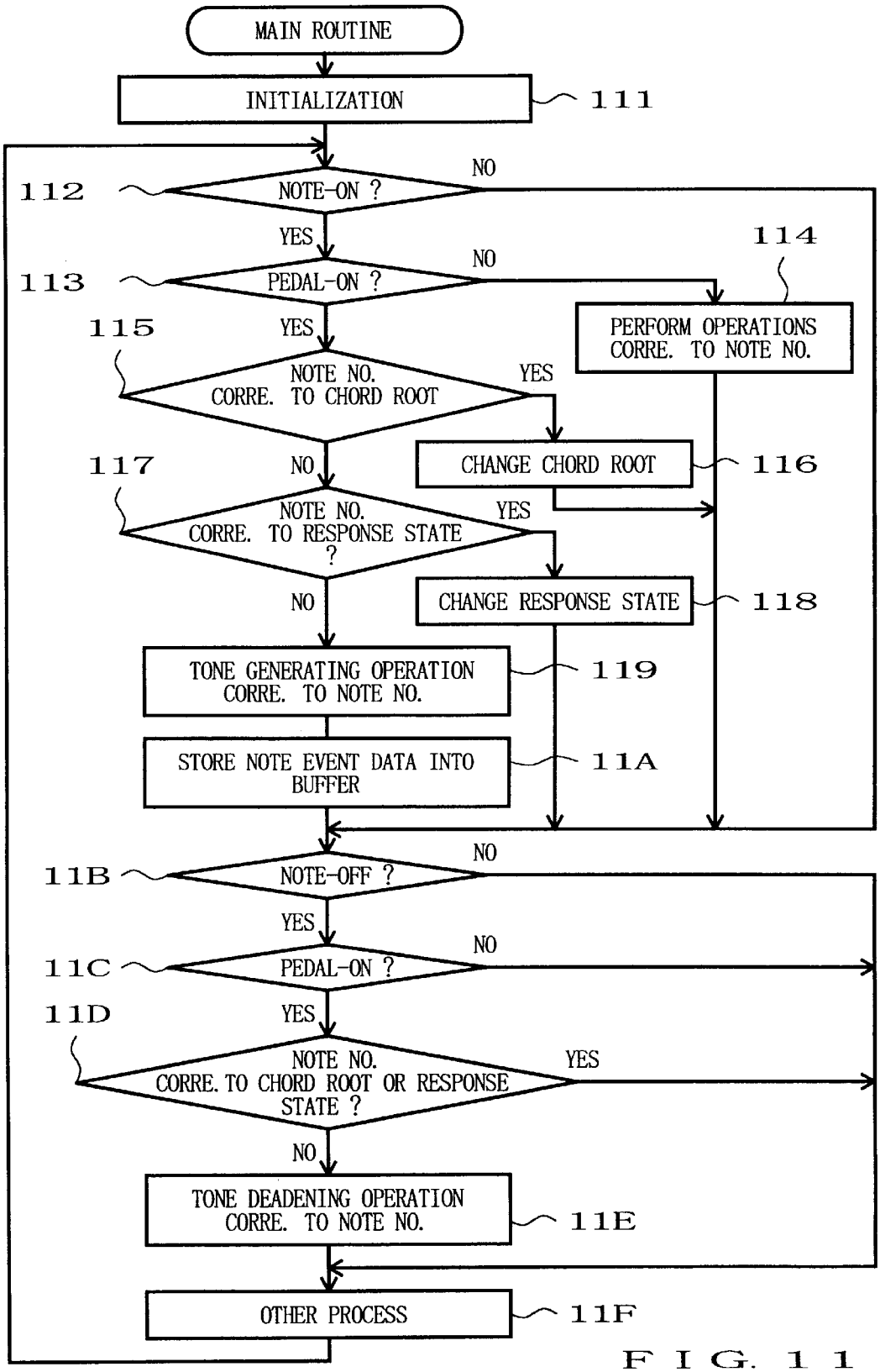
FIG. 11 is a flowchart illustrating an example of a main routine performed by a CPU of a personal computer of FIG. 1.

FIG. 11 is a flowchart illustrating an example of a main routine performed by the CPU 21.

Upon power-on, the CPU 21 starts performing processes in accordance with the control program stored in the ROM 22. In an initialization process, various registers and flags in the RAM 23 are set to the respective predetermined intial values or conditions, and various switch functions available when the pedal 1E*b* is not being depressed are allocated to the keys of the keyboard 1B.

At step 112, a determination is made as to whether an MIDI message received from the musical instrument 1H via the MIDI interface 1F and 2C is a note-on message or not. If the received MIDI message is a note-on message (YES), the CPU 21 goes to step 113, but if not, the CPU 21 jumps to step 11B.

At step 113, a determination is made as to whether the pedal 1E*b* is currently set ON, i.e., depressed. With a negative determination meaning that the player has only operated the keyboard 1B without operating the pedal 1E*b*, the CPU 21 proceeds to step 114 in order to perform various processes corresponding to the note number contained in the MIDI message. If the pedal 1E*b* is currently depressed as determined at step 113, it means that the player has operated the keyboard 1B while depressing the pedal 1E*b*, and thus the CPU 21 performs operations of step 115 to 11A.

At step 114 taken when the player has just operated the keyboard 1B without operating the pedal 1E*b*, there are performed various operations corresponding to the note number contained in the MIDI message received from the musical instrument 1H, i.e., operations corresponding to various switch functions allocated to the keyboard 1B as shown in FIG. 3.

For example, if the note number contained in the MIDI message is one of 36(C1) to 47(B1), the chord is changed to a chord root corresponding to the note number. If the note number is 48(C2), the cluster is changed to the first cluster (#1); if the note number is 50(D2), the cluster is changed to the second cluster (#2); and if the note number is 52(E2), the cluster is changed to the third cluster (#3).

If the note number contained in the MIDI message is 55(G2), the bass texture is changed to the first texture (#1); if the note number is 57(A2), the bass texture is changed to the second texture (#2); and if the note number is 59(B2), the bass texture is changed to the third texture (#3). If the note number is 60(C3), the chord texture is changed to the first texture (#1); if the note number is 62(D3), the chord texture is changed to the second texture (#2); and if the note number is 64(E3), the chord texture is changed to the third texture (#3).

Further, if the note number contained in the MIDI message is 66(F#3), response based on a bass response state is enabled, and if the note number is 68(G#3), response based on a chord response state is enabled. If the note number is 80(G#3), the chord type is changed to a dominant 7th (dom7); if the note number is 81(A4), the chord type is changed to a minor 7th (min7); if the note number is 82(A#4), the chord type is changed to a major (maj); and if the note number is 83(B4), the chord type is changed to a minor (min).

If the note number contained in the MIDI message is 84(C5), one of the rhythm patterns as shown in FIG. 9 is read out for one measure and stored into the RAM 23 and a drum reproduction flag DRUM is set to to indicate "enable" or "disable", in order to execute reproduction of drum sound. If the note number is 86(D5), a base reproduction flag is set to an enable/disable state, and if the note number is 88(E5), a chord reproduction flag is set to indicate "enable" or "disable".

Further, if the note number contained in the MIDI message is 89(F5), the CPU 21 starts an automatic performance, and if the note number is 90(F#5), the CPU 21 stops an automatic performance. If the note number is 91(G5), a real-time response flag RTA is set ON and the real-time response controller 31 is enabled. If the note number is one of 96(C6) to 105(A6), the response state is changed from a 0th state (#0) to a ninth state (#9).

The operation of step 115 is executed when the keyboard 1B is operated with the pedal 1E*b* depressed, where it is determined whether the note number contained in the MIDI message received from the electronic musical instrument 1H is one of 36(C1) to 47(B1) relating to a chord root change. If so, the CPU 21 proceeds to step 116 to change the chord root to the one corresponding to the note number; otherwise, the CPU 21 proceeds to step 117 to determine whether the note number contained in the MIDI message is one of 96(C6) to 105(A6) relating to a response state change.

If the note number corresponds to a response state change as determined at step 117, the CPU 21 goes to step 118 in order to change the response state to that corresponding to the note number, but if not, the CPU 21 performs operations of steps 119 and 11A.

At step 119, tone generating data corresponding to the note number, i.e., a note-on-related MIDI message is supplied to the tone source circuit 18 of the electronic musical instrument 1H, because the note number has been determined as not belonging to the chord-root-change instructing area or the response-state-change instructing area.

At step 11A, note event data such as a key code, velocity and duration (note length) contained in the MIDI message from the electronic musical instrument 1H are stored, at corresponding locations of a buffer that is divided into 96 locations per measure, in response to the event occurrence timing (activated time). The duration or note length is determined upon occurrence of a note-off event and stored at a location where the corresponding note-on event has been stored.

At step 11B, it is determined whether the MIDI message received from the electronic musical instrument 1H is a note-off message. With an affirmative (YES) determination, the CPU 21 proceeds to step 11C, but with a negative (NO) determination, the CPU 21 jumps to step 11F.

At step 11C, a determination is made as to whether the pedal 1E*b* is in the depressed or ON state. If the pedal 1E*b* is ON (YES), the CPU 21 proceeds to step 11D in order to further determine whether the note number contained in the MIDI message from the electronic musical instrument 1H is either one of 36(C1) to 47(B1) relating to a chord root change, or one of 96(C6) to 105(A6) relating to a response state change. If answered in the affirmative, the CPU 21 jumps to step 11F; if not, the CPU 21 proceeds to step 11E, where tone deadening data for that note number, i.e., note-off-related MIDI message is supplied to the tone source circuit 18 of the electronic musical instrument 1H. This causes the tone generated at step 119 to be deadened.

At step 11F, various other operations are performed such as one responsive to actuation of any of the operators on the operation panel 2B.

Next, a description will be made as to an example of automatic accompaniment processing that is performed by the CPU 21 in response to a timer interrupt signal when an automatic accompaniment has been initiated at the above-described step 114 by depressing the key of note number 89(F5) on the keyboard 1B without actuating the pedal 1E*b*. This automatic accompaniment processing comprises a pattern reproduction process, situation analyzation process, and chord-pattern and bass-pattern synthesization processing.

Figure 12:
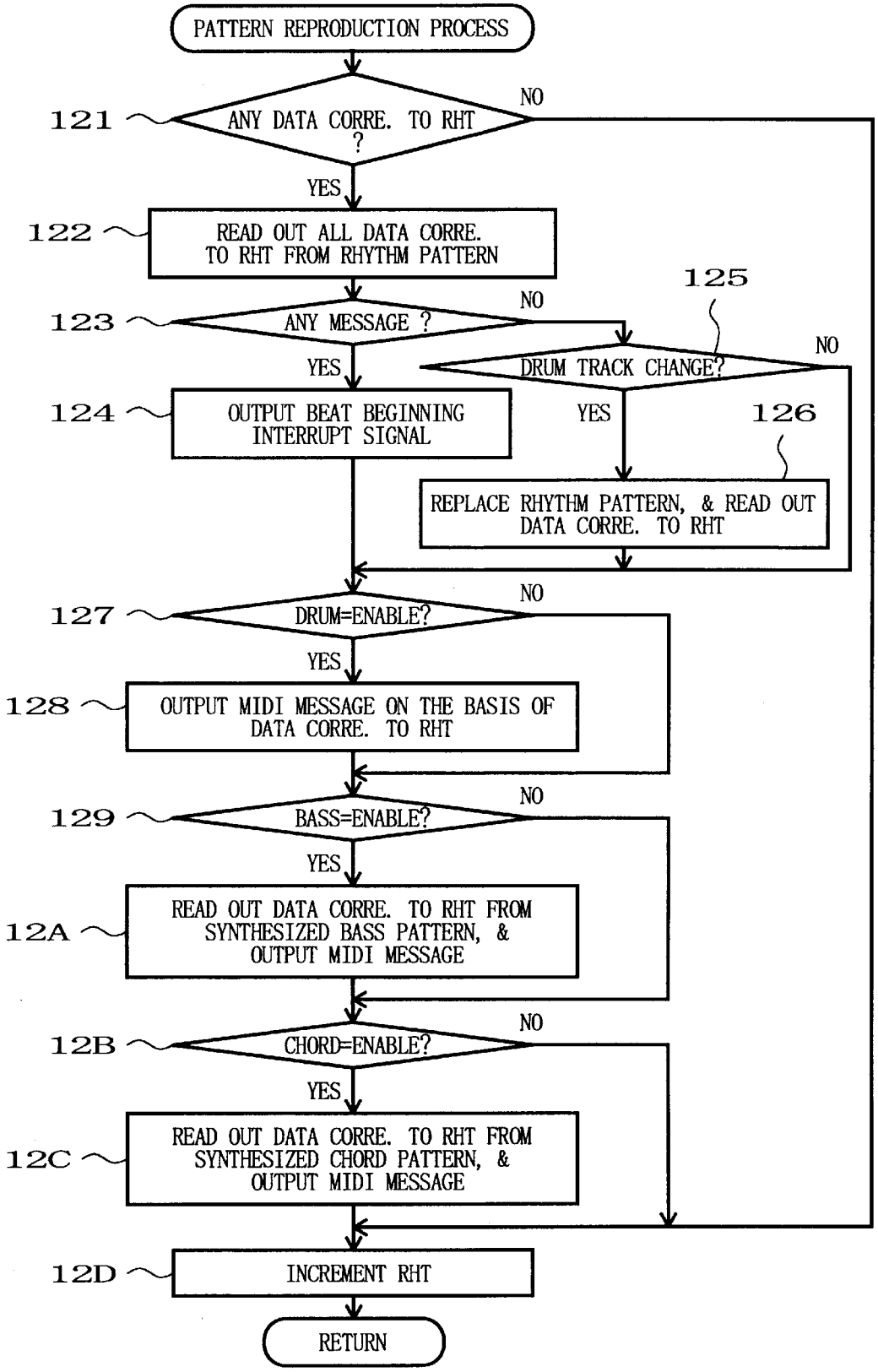
FIG. 12 is a flowchart showing an example of a pattern reproduction process performed by the CPU of the personal computer.
Figure 13:
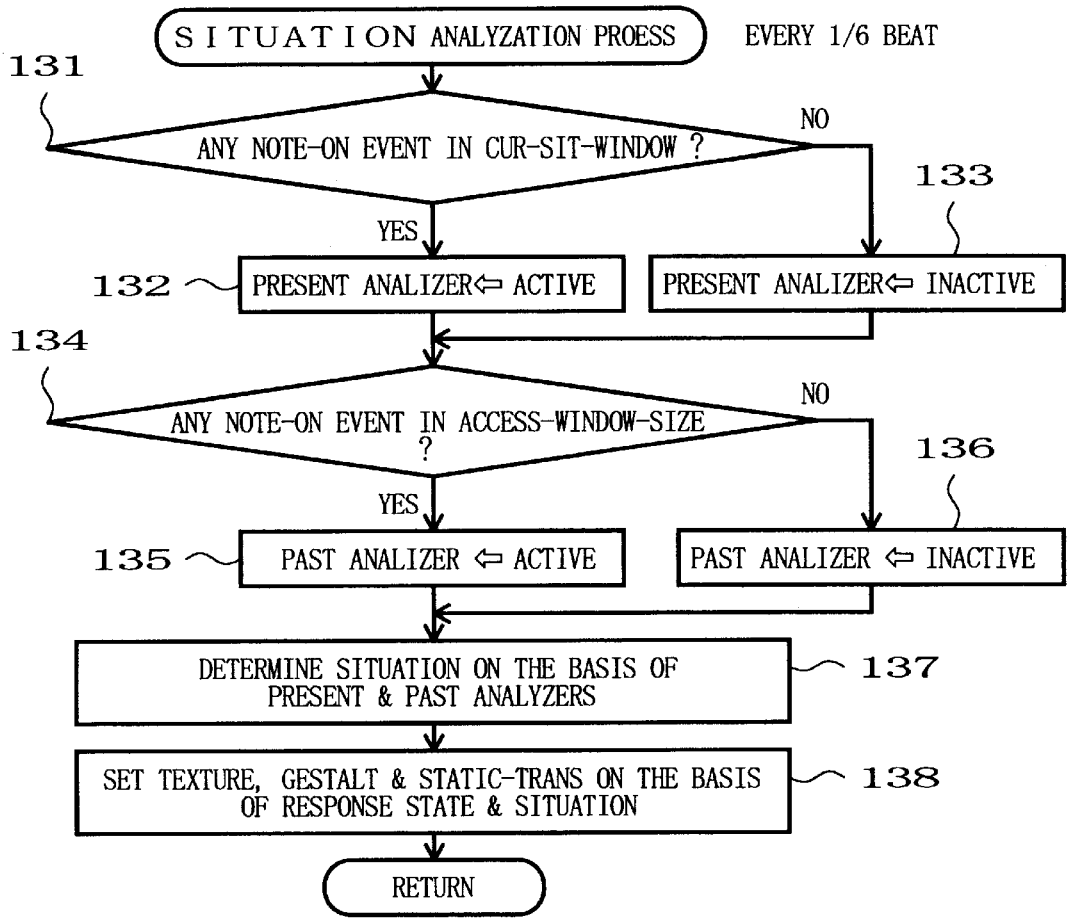
FIG. 13 is a flowchart showing an example of a situation analyzation process performed by the CPU of the personal computer.
Figure 16:
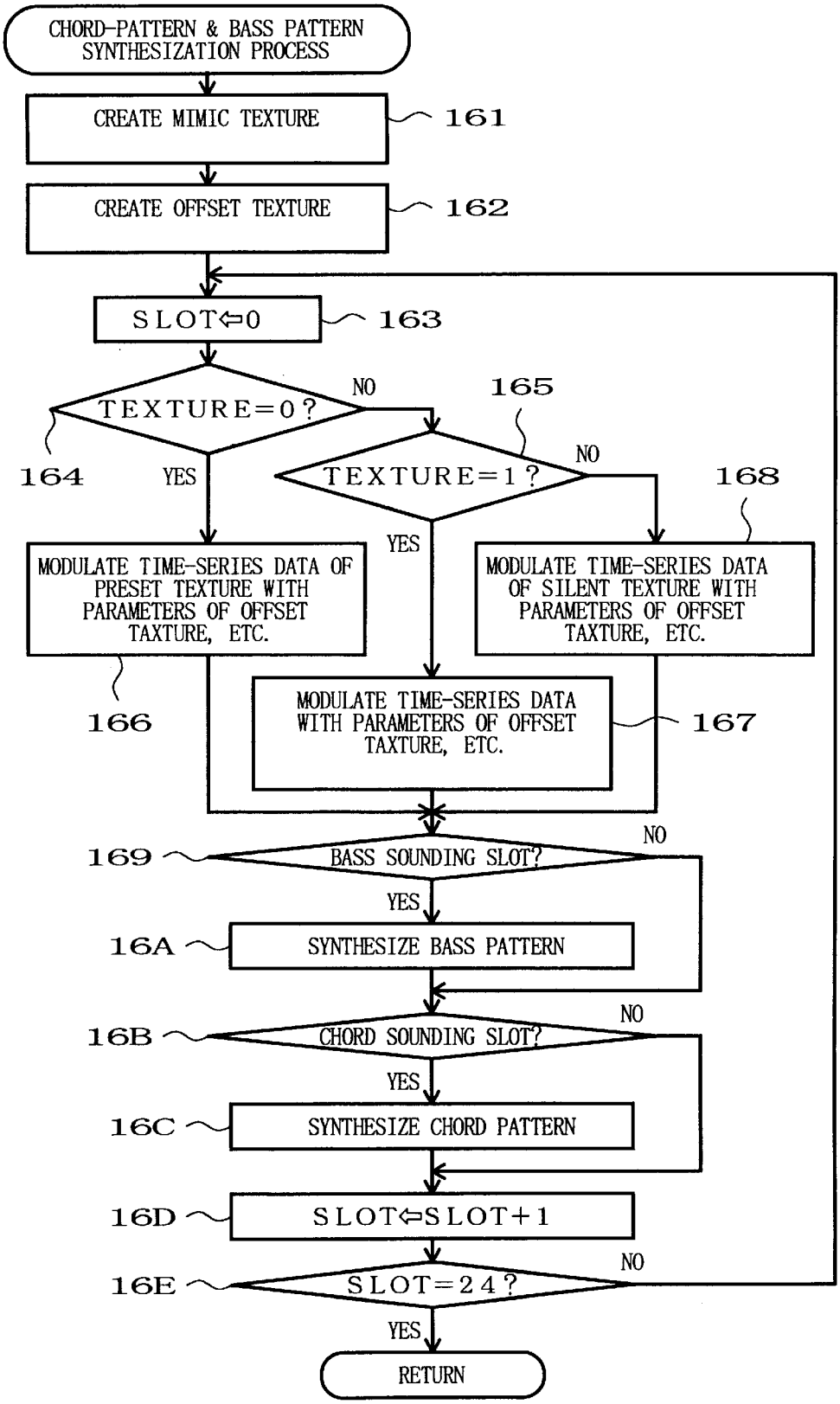
FIG. 16 is a flowchart showing an example of chord-pattern and bass-pattern synthesization processing performed by the CPU of the personal computer.

FIG. 12 is a flowchart showing an example of the pattern reproduction process, FIG. 13 is a flowchart showing an example of the situation analyzation process, and FIG. 16 is a flowchart showing an example of the chord-pattern and bass-pattern synthesization processing.

The pattern reproduction process is carried out in synchronism with the timer interrupt signal (generated at a frequency of 480 times per beat) corresponding to the current tempo value.

At step 121, a determination is made as to whether a rhythm pattern contains event data corresponding to a value currently set in a rhythm time register RHT. If so, the CPU 21 proceeds to step 122, but if not, the CPU 21 jumps to step 12D. At step 122, all the data corresponding to the value of the rhythm time register RHT are read out from the rhythm pattern.

At step 123, it is checked whether any data including the flag "MESSAGE" as shown in FIG. 9 is present in the readout data. If answered in the affirmative at step 123, the CPU 21 goes to step 124, but if answered in the negative, the CPU 21 jumps to step 125. Because the flag "MESSAGE" indicates the beginning of a beat, a beat beginning interrupt signal is output so that the chord-pattern and bass-pattern synthesization processing of FIG. 16 is initiated in synchronism with the beat beginning interrupt signal, at step 124. If the beat beginning interrupt signal corresponds to the beginning of a measure, i.e., a first beat of the measure, the situation analyzation process of FIG. 13 is initiated simultaneously.

At step 125, it is determined whether a drum track change is to be made, i.e., whether the texture value of the activity parameter in the drum response state is "1". If the value is "1" as determined at step 125, the CPU 21 does to step 126. The details of the response state will be explained later.

At step 126, a rhythm pattern of a pattern number corresponding to the number of keys to be depressed for one beat is newly read out to replace the current rhythm pattern; namely, the current rhythm pattern is replaced by the newly read-out rhythm pattern. By this operation, the rhythm pattern will be automatically changed from one to another depending on the number of keys to be depressed. Then, the data corresponding to the value of the rhythm time register RHT are read out from the new rhythm pattern.

At step 127, a determination is made as to whether the drum reproduction flag DRUM indicates "enable". If the flag DRUM indicates "enable", the CPU 21 proceeds to step 128, but if not, the CPU 21 jumps to step 129. At step 128, a MIDI message based on the data corresponding to the value of the rhythm time register RHT read out at step 122 or 126 is output to the tone source circuit 18 of the electronic musical instrument 1H, so that a drum part performance is effected in the instrument 1H. At step 129, a determination is made as to whether a bass reproduction flag BASS indicates "enable". If the flag BASS indicates "enable", the CPU 21 proceeds to step 12A, but if the flag BASS indicates "disable", the CPU 21 jumps to step 12B.

At step 12A, the data corresponding to the value of the rhythm time register RHT are read out from a bass pattern synthesized in the later-described chord-pattern and bass-pattern synthesization processing of FIG. 16, and a MIDI message based on the read-out data is output to the tone source circuit 18 of the electronic musical instrument 1H, so that a bass part performance is effected in the instrument 1H.

At step 12B, a determination is made as to whether a chord reproduction flag CHORD indicates "enable". If the chord reproduction flag CHORD indicates "enable", the CPU 21 proceeds to step 12C, but if the flag CHORD indicates "disable", the CPU 21 jumps to step 12D. At step 12C, the data corresponding to the value of the rhythm time register RHT are read out from a chord pattern synthesized in the later-described chord-pattern and bass-pattern synthesization processing of FIG. 16, and a MIDI message based on the readout data is output to the tone source circuit 18 of the electronic musical instrument 1H, so that a chord part performance is effected by the instrument 1H.

After that, the CPU 21 returns to the main routine after incrementing the value of the rhythm time register RHT by a predetermined value.

Next, the situation analyzation process of FIG. 13 will be described with reference to FIG. 14 which conceptually shows operation of the situation analyzation process.

This situation analyzation process is triggered upon reception of the beat beginning interrupt signal at the beginning of a measure, i.e., first beat of the measure and then performed at each interrupt timing occurring at an interval of ⅙ of a beat. Because the note event data have been stored, at step 11A of FIG. 11, in time series in the buffer divided into 96 storage locations per measure, only the note-on event data in the note event data stored in the buffer is extracted and the current situation is analyzed on the basis of the extracted note-on event data in the situation analyzation process. Because the occurrence timing of the note event data corresponds to one of 24 slots representing one beat, the individual storage locations in the buffer will be expressed by the corresponding slot numbers in the following description.

Figure 14:
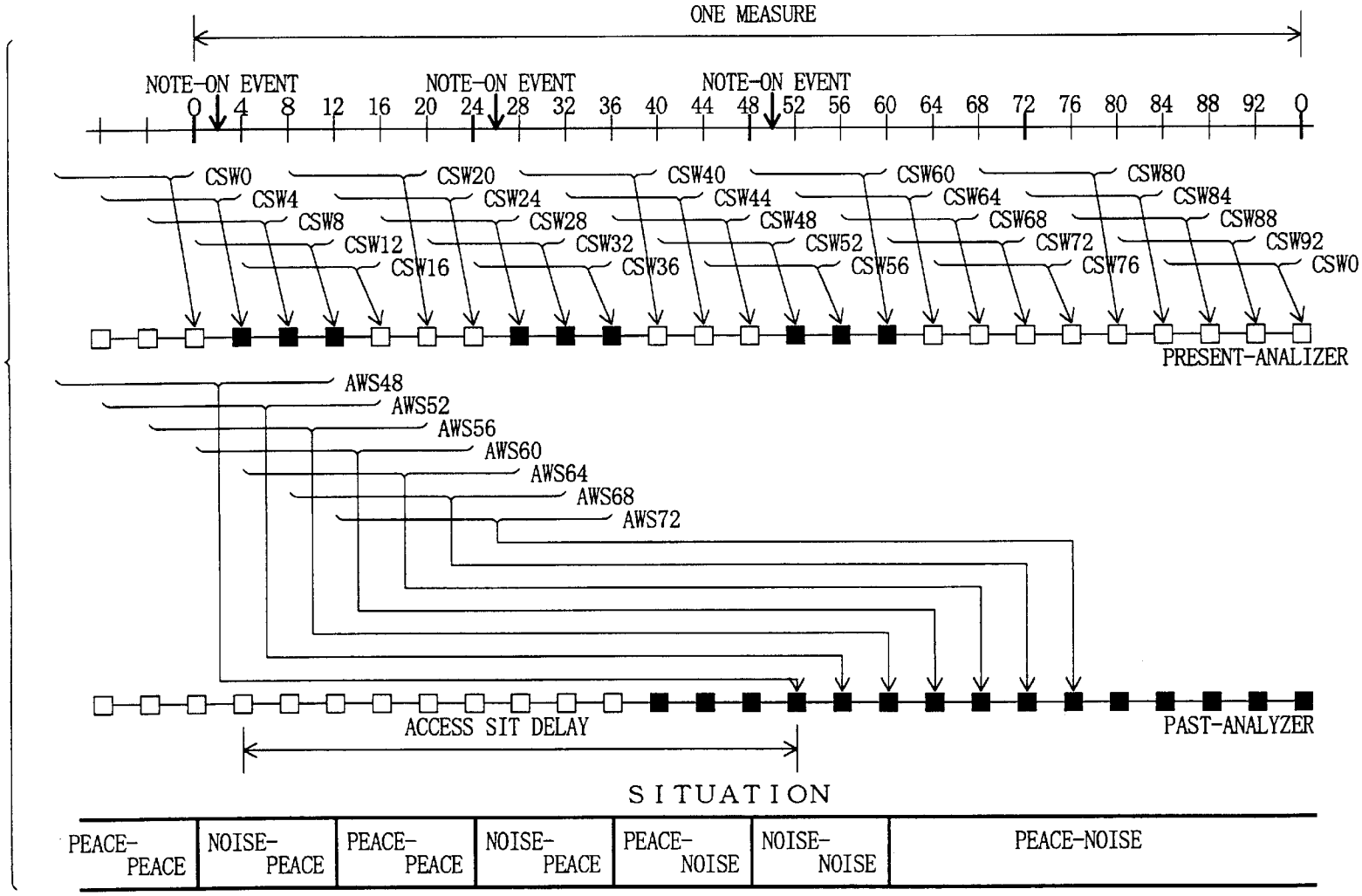
FIG. 14 conceptually shows operation of the situation analyzation process of FIG. 13.

Assume here that note-on events occur and are stored at slot numbers "2", "26" and "50" in the divided buffer as shown in FIG. 14. First, at step 131, it is determined whether any note-on event is present in a current situation window (Cur-Sit-Window). The "current situation window" is an analyzing window having a width corresponding to a half beat, i.e., 12 slots. Thus, at this step, it is determined whether any note-on event is present within last 12 slots (to the left in the figure) from the current time point, i.e., one of predetermined slot numbers "0", "4", "8", "12", "16", "20", . . . (hereinafter referred to as "determination slot numbers"). The CPU 21 goes to step 132 or 133 depending on the determination result of step 131.

If there is any note-on event in the current situation window as determined at step 131, "1" indicating "active" is set to a present analyzer flag; if, however, no note-on event is present in the current situation window, "0" indicating "inactive" is set to the present analyzer flag.

The results of the operations of steps 131 to 133 are shown in FIG. 14 in a region labelled as "PRESENT ANALYZER", where each black square block represents a determination result that there is a note-on event, i.e., "active" determination and each white square block represents a determination result that there is no note-on event, i.e., "inactive" determination. As will be clear from FIG. 14, if note-on events occur at slot numbers "2", "26" and "50", such note-on events will be found in the current situation windows (CSW4, CSW28, CSW52, CSW8, CSW12, CSW32, CSW36, CSW56 and CSW60) for determination slot numbers "4", "28" and "52" immediately after the slot numbers and subsequent determination slot numbers "8", "12", "32", "36", "56" and "60", respectively, and thus the present analyzer flag will indicate "active" for these determination slots, but indicate "inactive" for the other determination slots.

Then, at step 134, a determination is made as to whether any note-on event is present in an access window size AWS. As shown in FIG. 14 in areas labelled as "AWS . . . ", the access window size AWS is an analyzing window having a width corresponding to one beat, i.e., 24 slots. The access window size AWS is different from the above-mentioned current situation window in that it goes from a current time point (determination slot number) back to the past by an amount corresponding to an access situation delay (ACCESS SIT DELAY) in order to determine whether there is any note-on event within 24 slots before and after the determination slot number. In this embodiment, the value of the access situation delay is equivalent to two beats (48 slots). Therefore, this step 134 determines whether any note-on event is present between a location which is 60 slots before the current time point (determination slot number) and a location which is 36 slots before the current time point. The CPU 21 goes to step 135 or 136 depending on the determination result of step 134.

If there is a note-on event in the access window size as determined at step 134, "1" indicating "active" is set to a past analyzer flag; if, however, no note-on event is present in the window size, "0" indicating "inactive" is set to the past analyzer flag.

The results of the operations of steps 134 to 136 are shown in FIG. 14 in a region labelled as "PAST ANALYZER", where each black square block represents a determination result that there is a note-on event, i.e., "active" determination and each white square block represents a determination result that there is no note-on event, i.e., "inactive" determination, similarly to the above-mentioned. As will be clear from FIG. 14, if note-on events occur at slot numbers "2", "26" and "50", such note-on events will be found in the access window size AWS40 for determination slot number "40" which is 36 slots behind determination slot number "4" immediately following slot number "2" where the first note-on event has occurred. In this case, the past analyzer flag will indicate "active" for subsequent determination slot numbers "44", "48" and "52".

At step 137, a situation is determined on the basis of the operation results of steps 131 to 136, namely, the values of the present and past analyzer flags. The term "situation" as used herein means whether there was any performance (noise) or no performance (peace) in the current and past windows (CSW and AWS). At step 137, a condition where the present and past analyzer flags are both at the value of "1" indicative of "inactive" is determined as a peace—peace situation. In the example of FIG. 14, such a "peace—peace situation" determination is made for determination slot numbers "16", "20" and "24", and thus a range from slot number "12" to slot number "24" is in the peace—peace situation.

Further, a condition where the present analyzer flag indicates "active" and the past analyzer flag indicates "inactive" is determined as a noise-peace situation. In the example of FIG. 14, such a "noise-pease situation" determination is made for determination slot numbers "4", "8", "12", "28", "32" and "36", and thus ranges from slot number "0" to slot number "12" and slot number "28" to slot number "36" are in the noise-peace situation. Further, a condition where the present analyzer flag indicates "inactive" and the past analyzer flag indicates "active" is determined as a peace-noise situation. In the example of FIG. 14, such a "pease-noise situation" determination is made for determination slot numbers "40", "44", "48" and "64" to "0", and thus ranges from slot number "40" to slot number "48" and slot number "60" to slot number "0" are in the peace-noise situation. Finally, a condition where the present and past analyzer flags are both at the value of "1" indicative of "active" is determined as a noise—noise situation. In the example of FIG. 14, such a "noise—noise situation" determination is made for determination slot numbers "52", "56" and "60", and thus a range from slot number "48" to slot number "60" is in the noise—noise situation.

At step 138, predetermined values are stored into texture, gestalt and static-trans registers, on the basis of the determination result of step 137, i.e., the current situation and response state. The current response state can be identified on the basis of one of values "0" to "9" set in advance when a key corresponding to one of note numbers 96(C6) to 105(A6) is operated on the keyboard 1B.

FIG. 15 is a diagram showing examples of response states, which are tables that are provided for each of the four possible situations and prestore values to be stored in the texture register (T), gestalt register (G) and static-trans register (S) for each of the bass, chord and drum performance parts. In the figure, mark "*" indicates that the bass, chord and drum do not correspond to the parameter on the left.

In the texture register for each of the performance parts, there are prestored values "0", "1" and "2" indicating parameters to be used in synthesizing chord and bass patterns, i.e., indicating which of preset, mimic and silent textures is to be used. If the value stored in the texture register is "0", the preset texture will be selected; if "1", the mimic texture will be selected; and if "2", the silent texture will be selected. In this example, the preset texture represents a group of parameters prepared for forming predetermined bass and chord patterns, the mimic texture represents a group of parameters obtained on the basis of analysis of a player's real-time performance; and the silent texture represents a group of parameters prepared for preventing formation of bass and chord patterns. The mimic texture is a texture for forming bass and chord patterns approximating the contents of a player's real-time performance. As previously noted, for rhythm patterns, a selection is just made as to whether the rhythm pattern replacement process is to be executed in accordance with the texture value.

In the gestalt register for each of the performance parts, there are prestored values "−10" to "10" as values to be multiplied into an analyzed result of a real-time performance. Further, in the static-trans register for each of the performance parts, there are prestored values from "0" to "127".

The chord-part and bass-pattern synthesization processing will vary in contents on the basis of the values of the texture, gestalt and static-trans registers obtained from the situation analyzation process.

Now, the chord-pattern and bass-pattern synthesization processing of FIG. 16 will be described in further detail, which is triggered by the beat beginning interrupt signal output at step 124 of the pattern reproduction process of FIG. 12.

First, at step 161, mimic textures for the two parts are created by analyzing a MIDI message (performance input information) received from the keyboard 1B via the MIDI interfaces 1F and 2C. In this mimic texture creating operation, parameters are created which are indicated in black circle in a table of FIG. 18A, as will be described below.

In the mimic texture creating operation, an analysis is made on the basis of the note event data (key code, velocity and duration) having been stored in the buffer at step 11A of FIG. 11. Then, the respective note-on event occurrence times (note-on times) are quantized to reference slot positions (slot numbers "0", "6", "12" and "18") corresponding to sixteenth notes. That is, note-on events having occurred within two slots before each of the reference slot positions and within three slots after the reference slot position are treated as having occurred at that reference slot position. For example, if the note-on time is "2" as shown in FIG. 14, the note-on event is treated as having occurred at reference slot number "0". Therefore, if the note event data corresponds to a triplet of sixteenth notes or eighth notes, the analyzed data is compulsorily quantized to even-number notes. Namely, note-on event data corresponding to a triplet can not be recognized in the embodiment, although such data may of course be made recognizable. These data quantized to the respective reference slot positions in the above-mentioned manner will be called "sixteenth-note extract data".

Then, a note-on pattern is created by indicating, by values "0" and "1", absence and presence of a note-on event at the reference slot positions (slot numbers "0", "6", "12" and "18"), as shown in FIG. 17: presence of a note-on event is indicated by "1" and absence of a note-on event is indicated by "0". There can be created sixteen different note-on patterns from "(0000)" to "(1111)". The leftmost value corresponds to slot number "0", the second value from the leftmost corresponds to slot number "6", the second value from the rightmost corresponds to slot number "12", and the rightmost value corresponds to slot number "18". Thus, in the case of the occurrence times of FIG. 14, there will be created a note pattern (1000) for each beat.

Once a note-on pattern has been detected, the values of the activity and syncopation parameters are analyzed on the basis of the detected note-on pattern.

As shown in FIG. 17, the activity parameter values correspond to note-on patterns in a one-to-one relation, and comprise combinations of fixed values "0", "1", "60" and "120". It should be obvious that other activity value patterns than those shown in FIG. 17 may be employed. For example, if the note-on pattern is (1000) as shown in FIG. 14, the activity pattern for the reference slot positions will be (1111). If the note-on pattern is (0011) as shown in FIG. 14, the activity pattern for the reference slot positions will be (60 120 60 120) which are the activity parameter values only at slot numbers "0", "6", "12" and "18"; thus the activity parameter values at the other slot numbers "1" to "5", "7" to "17" and "19" to "23" are all "0".

The thus-obtained values are used as the activity parameters for the rhythm mimic texture, bass mimic texture and chord mimic texture.

As shown in FIG. 17, the syncopation parameter values also correspond to note-on patterns in a one-to-one relation, and comprise combinations of fixed values "0", "40" and "80" and values calculated by arithmetic expressions. For note-on patterns (0000), (1000), (0100), (0010), (0110) and (0101), the respective syncopation parameters consist of combinations of the fixed values "0", "40" and "80" alone; however, for note-on patterns (1100), (0001), (1001), (1101), (0011) and (0111), the respective syncopation parameters consist of combinations of the fixed values "0", "40" and "80" and values calculated by arithmetic expressions. For note-on patterns (1010), (1110), (1011) and (1111), the respective syncopation parameters consist of combinations of the values calculated by arithmetic expressions alone. In the example of FIG. 14, note-on pattern (1000) is obtained so that the syncopation parameter takes a value of (0000).

Further, for note-on pattern (1100), values obtained by an arithmetic expression "Vel[6]−Vel[0]" are used as the syncopation parameter values for slot numbers "0" and "12". In the arithmetic expression, "Vel[0]" represents a velocity value of one of the note-on data quantized to reference slot position "0" which relates to an earliest note-on time. That is also the case with Vel[6], Vel[12] and Vel[18].

The thus-obtained values are set as the syncopation parameters for the rhythm mimic texture, bass mimic texture and chord mimic texture.

Further, a velocity value of one of the note-on data quantized to each reference slot position which relates to an earliest note-on time is used as a volume parameter for that reference slot position, and the thus-obtained values are set directly as the volume parameters for the rhythm mimic texture, bass mimic texture and chord mimic texture.

Scale duration parameters for the chord mimic texture, bass mimic texture and chord mimic texture are determined in the following manner. First, a value for each of the reference slot positions is determined on the basis of a note duration value of one of the note-on data quantized to each reference slot position which relates to an earliest note-on time and the already-analyzed activity parameter value. Because the activity parameter value is a combination of values "0", "1", "60" and "120", the duration and scale duration parameters for the reference slot position are "0" when the activity parameter value is "0". When the activity parameter value is "1", a value obtained by dividing the note duration by "480" and then multiplying the division result by "127" is set as the values of the duration and scale duration parameters. When the activity parameter value is "120", a value obtained by dividing the note duration by "120" and then multiplying the division result by "127" is set as the values of the duration and scale duration parameters. This is equivalent to normalizing the actual note duration value in accordance with the activity parameter.

Syncopation parameter pattern indicates syncopation parameter values at slot numbers "0", "6", "12" and "18" as in the case of the above-mentioned activity pattern. The syncopation parameter values may be set in any other manner than shown in FIG. 17.

The thus-obtained values are set as the duration parameter for the chord mimic texture and the scale duration parameter for the mimic texture.

The chord tone parameter, dull tone parameter and ripe tone parameter of the bass mimic texture are determined in the following manner. The respective values of the parameters are selected depending on a particular tone in one of the tone lists (previously-selected tone list) of FIG. 6 to which corresponds the pitch of one of the note-on data quantized to each reference slot position relating to an earliest note-on time. Where the pitch corresponds to a chord tone in the tone list, the chord parameter value is set to "120" and the values of the dull tone parameter and ripe tone parameter are both set to "0". Where the pitch corresponds to a dull tone in the tone list, the chord parameter is set to value "64", the dull tone parameter to "120", and the ripe tone parameter to "0". Where the pitch corresponds to a ripe tone in the tone list, the chord parameter is set to value "64", the dull tone parameter to "0", and the ripe tone parameter to "120". The determination of the parameter values is made in consideration of the chord root and chord type designated by the above-mentioned chord root key and chord type key.

The thus-obtained values are set as the chord tone parameter, dull tone parameter and ripe tone parameter for the bass mimic texture.

The direction parameter and leaper parameter for the bass mimic texture are determined on the basis of whether the pitch of one of the note-on data quantized to each reference slot position relating to an earliest note-on time is higher or lower than the pitch at the preceding reference slot position and on the basis of a difference in the pitches. For example, when there is no difference from the pitch at the preceding reference slot position (when a same pitch is detected at the two slot positions), the direction parameter is set to a value "0" and the leaper parameter is set to "25". However, when there is a difference from the pitch at the preceding reference slot position, the direction parameter is set to a value "127" and the leaper parameter is set to a value obtained by subtracting "1" from the absolute value of the pitch difference, multiplying the subtraction result by "7" and then adding "40" to the multiplication result.

The thus-obtained values are set as the direction and leaper parameters for the bass mimic texture.

A value obtained by multiplying the number of note-on events quantized to each reference slot position by "13" becomes the number-of-notes parameter for the reference slot position and is set directly as the number-of-notes parameter for the chord mimic texture.

The average pitch value of all notes quantized to each reference slot position becomes the register parameter for the reference slot position and is set directly as the register parameter for the chord mimic texture. When there is no note-on event at the reference slot position, "64" is set as the parameter value.

A value obtained by subtracting the minimum pitch value of all notes quantized to each reference slot position from the maximum pitch value and multiplying the subtracted result by "6" becomes the range parameter for the reference slot position and is set directly as the range parameter for the chord mimic texture.

Then, at step 162 of FIG. 16, parameters for bass-offset and chord-offset textures are created on the basis of the individual parameters of the mimic textures created at step 161. This offset texture creation process will be described below.

For each of the activity, syncopation, volume, duration, direction, number-of-notes, register and range parameters in the mimic textures created at step 161, a value obtained by dividing the sum of the values at the reference slot positions for one beat by the number of slots where note-on events have occurred is set as its average value for one beat length. For the dull tone parameter in the mimic textures, a value obtained by dividing the sum of the values at the reference slot positions for one beat by the number of slots where note-on events have occurred is set as the average value for one beat length of the color-a parameter. For the ripe tone parameter in the mimic textures, a value obtained by dividing the sum of the values at the reference slot positions for one beat by the number of slots where note-on events have occurred is set as the average value for one beat length of the color-b parameter.

FIG. 18A shows on which mimic texture's parameters the thus-calculated average values of the parameters are based. Because the activity, syncopation, and volume parameters in the bass mimic, chord mimic and rhythm mimic textures are of the same value, any desired value may be used for these parameters.

The individual parameters for the bass-offset and chord-offset textures are created on the basis of the thus-calculated respective average values AV of the parameters. FIG. 18 B shows how off-set texture parameters are created on the basis of the average values of the parameters. For each of the activity, syncopation, volume and register parameters for the bass-offset texture, a value is employed which is obtained by subtracting "64" from the per-beat average value of the parameter and halving the subtraction result. For the scale duration parameter for the bass-offset texture, a value is employed which is obtained by subtracting "64" from the per-beat average value of the duration parameter and dividing the subtraction result by "−2". For the dull tone parameter for the bass-offset texture, a value is employed which is obtained by subtracting "64" from the per-beat average value of the color-a parameter and dividing the subtraction result by "2". For the ripe tone parameter for the bass-offset texture, a value is employed which is obtained by subtracting "64" from the per-beat average value of the color-b parameter and dividing the subtraction result by "2". Further, for the direction-tone parameter for the bass-offset texture, a value is employed which is obtained by subtracting "64" from the per-beat average value of the direction parameter and multiplying the subtraction result by "2".

For each of the activity, syncopation, volume, color-a, color-b, register and range parameters for the chord-offset texture, a value is employed which is obtained by subtracting "64" from the per-beat average value of the parameter and halving the subtraction result. For the duration parameter for the chord-offset texture, a value is employed which is obtained by subtracting "64" from the per-beat average value of the duration parameter and dividing the subtraction result by "−2". For the density parameter for the chord-offset texture, a value is employed which is obtained by subtracting "64" from the per-beat average value of the number-of-notes parameter and dividing the subtraction result by "2".

In the above-mentioned manner, the bass-offset and chord-offset textures are created.

At step 163 of FIG. 16, a slot number register SLOT is set to a value "0". Then, at steps 164 and 165, a determination is made as to what are the current values of the texture register for the individual parameters that have been determined from the situation and response state. For each parameter whose value is "0" as determined at step 164, the CPU 21 goes to step 166; for each parameter whose value is "1" as determined at step 165, the CPU 21 goes to step 167; and for each parameter whose value is "2" as determined at step 165, the CPU 21 goes to step 168.

At step 166, the time-series data of the preset texture, i.e., time-series parameter values as shown in FIG. 4 are respectively modulated (added with predetermined values) on the basis of the offset texture parameters created at the above-described step 162, a product between a gestalt value and wheel value WH2, static-trans value and wheel value WH1 (these will be called "individual parameters of the offset texture").

At step 167, the time-series data of the mimic texture created at the above-described step 161 are also respectively modulated on the basis of the "individual parameters of the offset texture". Similarly, at step 168, the time-series data of the silent texture are respectively modulated on the basis of the individual parameters of the offset texture.

The operations of steps 161 to 168 will now be described using a functional block diagram of FIG. 19. Only the bass pattern synthesization is representatively described and shown in FIG. 19 because the bass pattern synthesization and chord pattern synthesization are virtually the same in contents.

Figure 19:
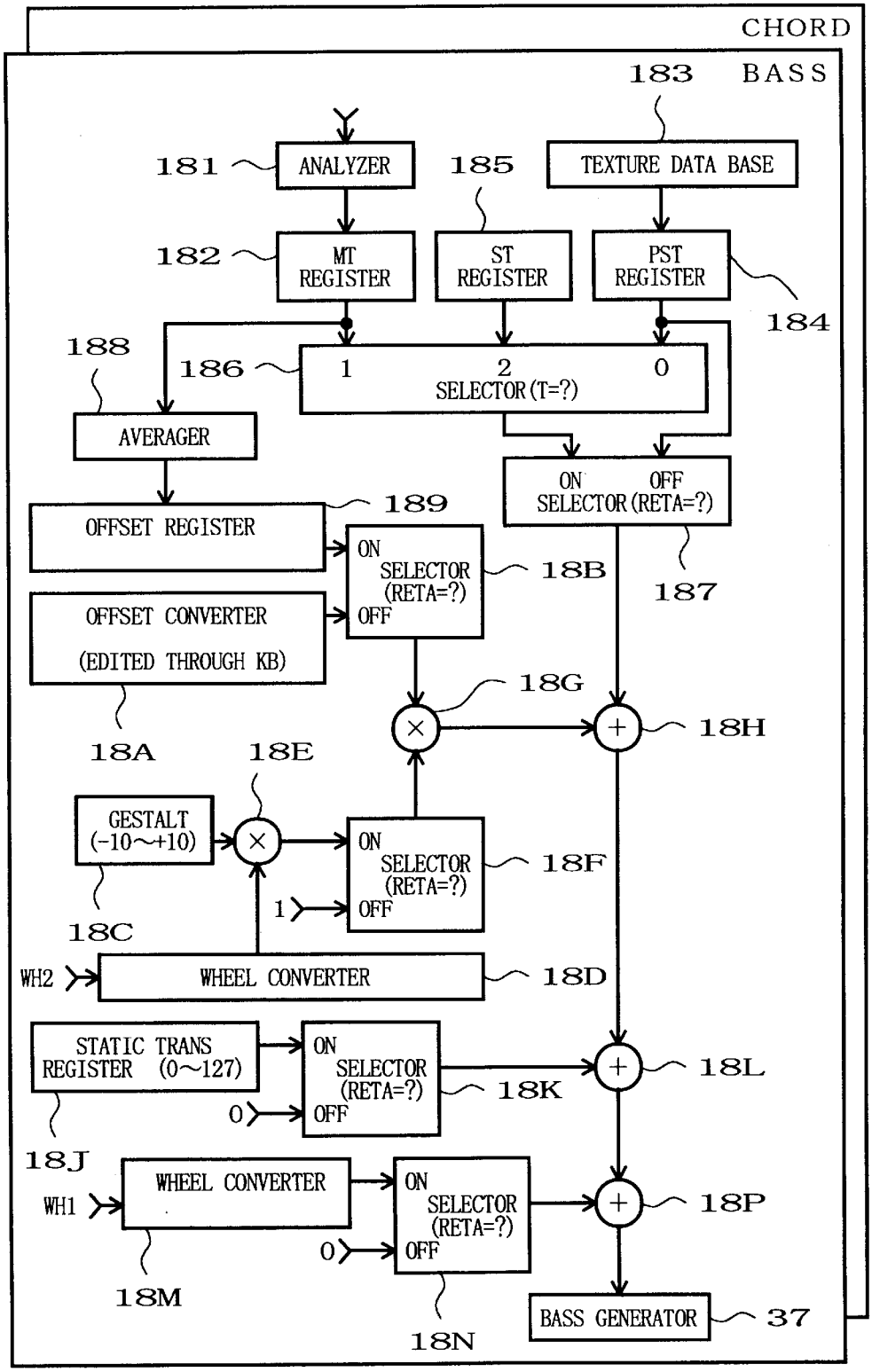
FIG. 19 is a functional block diagram corresponding to operations of steps 161 to 168 of FIG. 16.

In FIG. 19, analyzer 181, which performs the operation of step 161, analyzes the MIDI message (performance input information) received from the keyboard 1B via the MIDI interfaces 1F and 2C so as to create a bass mimic texture and store in into an MT storage area 182. Analyzed value of each parameter at the current slot having been obtained by the MIDI message analysis is set to an address, corresponding to the slot, of the bass mimic texture which is a time-series data structure for one measure, and is stored into the MT storage area 182. After slot "95" comes slot "0", so that the analyzed values are sequentially set in the MT storage area 182 in a cyclic fashion.

Texture data base 183 corresponds to the hard disk device 24, which stores therein a total of nine bass textures, three bass textures (bass #1 to #3) for each of clusters #1 to #3. Time-series data for one measure are created on the basis of one of the bass textures which is selected from the data bass in response to depression of one of "C2", "D2" and "E2" keys and one of "G2", "A2" and "B2" on the keyboard 1B. These data are stored into a PST storage area 184 as a preset texture. Namely, since the bass texture is as shown in FIG. 4A, and it is converted into the time-series data as shown in FIG. 4B to be stored into the PST storage area 184.

In an ST storage area 185 is stored a silent texture comprising predetermined parameters which will keep quiet a bass or chord performance.

A value read out from the MT storage area 182 using, as an address, a remainder resulting from dividing a value of (the current slot number−the access situation delay value) by "96" is then supplied to a selector 186 and averager 188. Also, values read out from the ST and PST storage areas 185 and 184 using the current slot number as an address are supplied to the selector 186. For each of the parameters, the selector 186 selects any one of the three supplied readout values on the basis of the current value in the texture register and outputs the selected value to a next selector 187, and to this end, the selector 186 performs operations corresponding to the above-described operations of steps 164 and 165. By delaying only the address for readout from the MT storage area 182, the following operation takes place.

Namely, when the selector 186 selects the PST storage area 184 or ST storage area 185, an offset value based on performance information for the slot earlier than the current slot by an amount corresponding to the access situation delay is added by an adder 18H (as will be later described), so that a pattern reproduced on the basis of read-out values from the selected storage area can be modified by the performance information for the slot earlier than the current slot by an amount corresponding to the access situation delay (otherwise, the accompaniment pattern will not be modified because read-out values from the PST storage area 184 or ST storage area 185 are constant). When the selector 186 selects the MT storage area 182, there is reproduced a pattern comprising performance information for the slot earlier than the current slot by an amount corresponding to the access situation delay, so that an accompaniment pattern imitating a real performance (i.e., accompaniment pattern reflecting characteristics of the real performance) is reproduced with a time delay corresponding to the access situation delay value.

The selector 187 receives at its first terminal the texture selected by the selector 186 and receives at its second terminal the preset texture stored in the PST storage area 184. The selector 187 provides the adder 18H with the texture selected by the selector 186 when a real-time analyzer flag RETA indicates "ON", but provides the adder 18H with the preset texture when the flag RETA indicates "OFF". The real-time analyzer flag RETA is set to "ON" when the pedal is depressed, and is set to "OFF" when the pedal is released. The real-time analyzer flag RETA is also set to "ON" when the "G5" key is depressed while the pedal is released.

The averager 188 performs an operation corresponding to the above-described operation of step 162. Namely, for each of the activity, syncopation, volume, duration, dull tone, ripe tone, direction and register parameters in the mimic texture from the MT storage area 182, the averager 188 calculates an average value by dividing the sum of values at the reference slot positions for one beat by the number of slots where note-on events have occurred, creates a bass offset texture in the manner shown in FIG. 18B on the basis of the average value, and then stores the bass offset texture into an offset storage area 189.

Offset converter 18A converts a value of force, with which a predetermined key (one of the keys having no defined function) on the keyboard 1B is depressed, into a value corresponding to each parameter of an offset texture (offset value), and outputs the converted value to a selector 18B. Thus, when the real-time analyzer is "OFF", it is allowed to slightly modify a bass pattern generated on the basis of the preset texture.

The selector 18B receives at its first terminal the offset texture from the offset storage area 189 and receives at its second terminal the offset value from the offset converter 18A. Thus, the selector 18B provides a multiplier 18G with each parameter of the offset texture in the storage area 189 when the real-time analyzer flag RETA indicates "ON", but provides the multiplier 18G with the offset value from the offset converter 18A when the flag RETA indicates "OFF".

Gestalt storage area 18C is a gestalt register for storing a gestalt value obtained by the operation of step 138 of FIG. 13 and provides a multiplier 18E with a gain value between "−10" to "10". The gestalt value changes in accordance with the situation, and the bass pattern changes in response to a change in the situation.

Wheel converter 18D converts an operation signal WH2 received from the modulation wheel into a predetermined value and outputs the converted value to the multiplier 18E, which in turn multiplies the gain value from the gestalt storage area 18C and the converted value from the wheel converter 18D and provide the multiplication result to a first terminal of the selector 18F. For each of the range, leaper, number-of-notes, density, range and sub-range parameters, the wheel converter D just outputs a coefficient "1" to the multiplier 18E rather than performing no conversion, and thus the value stored in the gestalt storage area 18C is output, without being changed, to the selector 18F. By operating one of the wheels, the gestalt value is caused to change, so that the output value from the selector 18B changes, hence resulting a change in the bass pattern.

The selector 18F receives at its first terminal the multiplication result from the multiplier 18E and receives at its second terminal a coefficient "1". Thus, the selector 18F provides the multiplier 18G with the multiplication result from the multiplier 18E when the real-time analyzer flag RETA indicates "ON", but provides the multiplier 18G with the coefficient "1" when the flag RETA indicates "OFF".

The multiplier 18G multiplies together the output values from the selectors 18B and 18G and provides the multiplication result to the adder 18H, which in turn adds the texture parameter value from the selector 187 to the multiplication result of the multiplier 18G and then provides the addition result to an adder 18L. Static-trans storage area 18J is a static-trans register for storing a static-trans value obtained by the operation of step 138 of FIG. 13 and provides a selector 18K with a value between "0" to "127". The static-trans value changes in accordance with the situation, and the bass pattern changes in response to a change in the situation.

The selector 18K receives at its first terminal the static-trans value from the static-trans storage area 18J and receives at its second terminal a coefficient "0". Thus, the selector 18K provides an adder 18L with the static-trans value when the real-time analyzer flag RETA indicates "ON", but provides the adder 18L with the coefficient "0" when the flag RETA indicates "OFF". The adder 18L adds together the value selected by the selector 18K and the value (parameter value) from the adder 18H and then provides the addition result to another adder 18P.

Wheel converter 18M converts an operation signal WH1 received from the pitch-bend wheel into a predetermined value and divides the converted value by another predetermined value. For example, in the case of the activity and volume parameters, the converted value is divided by a coefficient "2"; in the case of the color-a and range parameters, the converted value is divided by a coefficient "3"; in the case of the syncopation and ripe tone parameters, the converted value is divided by a sum of a coefficient "1" and a value randomly selected from among coefficients "1" to "4"; and in the case of the dull tone parameter, the converted value is divided by a sum of a coefficient "1" and a value randomly selected from among coefficients "1" to "8". In the case of the other parameters than the above-mentioned, the wheel converter 18M outputs "0".

The selector 18N receives at its first terminal the converted value from the wheel converter 18M and receives at its second terminal a coefficient "0". Thus, the selector 18N provides an adder 18P with the converted value from the wheel converter 18M when the real-time analyzer flag RETA indicates "ON", but provides the adder 18P with the coefficient "0" when the flag RETA indicates "OFF". The adder 18P adds together the value selected by the selector 18N and the value (parameter value) from the adder 18L and then outputs the addition result to the bass generator 37.

The bass generator 37 performs the operations of steps 169 and 16A to synthesize a bass pattern, further performs the operation of step 12A in the pattern reproduction process of FIG. 12 on the basis of the synthesized bass pattern, and supplies a MIDI message to the tone source circuit 18. Although not shown, the chord generator 36 performs the operations of steps 16B and 16C to synthesize a chord pattern, further performs the operation of step 12C of FIG. 12 on the basis of the synthesized chord pattern, and supplies a MIDI message to the tone source circuit 18.

At step 169 of FIG. 16, a determination is made as to whether or not bass event occurrence at the current slot is proper on the basis of the values of the activity and syncopation parameters from the adder 18P. If bass event occurrence is proper (YES), the CPU 21 proceeds to next step 16A to perform the bass pattern synthesization process, but if not, the CPU 21 jumps to step 16B to perform operations relating to the chord generator 36.

At step 16A, now that bass event occurrence is proper as determined at the above-mentioned step 169, a single note to be sounded is determined on the respective parameters from the adder 18P (direction, leaper, chord tone, dull tone, ripe tone and scale parameters). Namely, a pitch change direction is determined on the basis of a note determined in an operation preceding the current one (last bass note) and on the direction parameter. Then, a minimum pitch change width (leap size) is determined on the basis of the leaper parameter. After that, a single note to be sounded is determined on the chord tone, dull tone and ripe tone parameters and tone list, and duration and velocity of the note to be sounded are determined on the basis of the scale parameter and of the syncopation and volume parameters, respectively.

At step 16B, similarly to step 169, a determination is made as to whether or not chord event occurrence at the current slot is proper on the basis of the modulated values of the activity and syncopation parameters. If chord event occurrence is proper (YES), the CPU 21 proceeds to next step 16C to perform the chord pattern synthesization process, but if not, the CPU 21 jumps to step 16D to increment the value of the slot number register SLOT by "1".

At step 16C, now that chord event occurrence is proper as determined at the above-mentioned step 16B, chord component tones to be sounded are determined on the respective parameters (duration, number-of-notes, register, range, sub-range, density, color-a and color-b parameters). Namely, first, duration of a chord to be sounded is determined on the basis of the duration parameter; the number of notes to be simultaneously sounded is determined on the basis of the number-of-notes parameter; a pitch range of the notes is determined on the basis of the register and range parameters; and then a pitch interval of notes to be sounded at a same slot is determined on the basis of the density parameter.

After that, candidates for the note component notes are extracted on the basis of the color-a and color-b parameters and selection probability calculating table as shown in FIG. 8. An example of a manner in which candidates for the note component notes are extracted will be explained below with reference to FIG. 20.

FIG. 20 is a mapping diagram showing note numbers within a pitch range determined by the register and range parameters, in corresponding relations to the individual pitches of the selection probability calculating table of FIG. 8A. In FIG. 20, it is assumed that the register parameter is key code C3 (note number "60"), range parameter is "60", density parameter "64", color-a parameter "127" and color-b parameter "0", and that the first level coefficient REQUIRED and second level coefficient OPTIONAL 1 are of the same value and the third level coefficient OPTIONAL 2 is "0". Therefore, the note numbers associated with the first level coefficient REQUIRED and second level coefficient OPTIONAL 1 are shown in the figure in black circles, while the note numbers associated with the third level coefficient OPTIONAL 2 are shown in the figure in white circles.

In the example of FIG. 20, the lowest pitch is key code F#0 (note number "30") and the highest pitch is key code F#5 (note number "90"). In the following description, each key code will be followed by the corresponding note number, and thus key codes F#0(30) to key code F#5(90) will be mapped which correspond to the individual pitches of the selection probability calculating table.

Candidates for chord component tones to be sounded at a slot (same time) are selected through the following procedures on the basis of the mapping diagram. The following description will be made on the assumption that C major is designated as a chord, but when another chord is designated, it is only necessary that any one of the selection probability calculating tables corresponding to the designated chord type be used and each note number be shifted in accordance with the root of the designated chord.

In the first procedure, the lowest root note in the pitch range, i.e., key code C1(36) in the figure is selected as a lowest pitch note. Then, a pitch interval depending on the density is added to the lowest pitch note so as to determine a second reference pitch. Since, as shown in FIG. 7, the pitch interval is "4" when the density is "64", key code E1(40) corresponding to a sum of key code C1(36) and pitch interval "4" becomes a next reference pitch. Then, the respective selection probabilities of eight pitches, ranging from the reference pitch to the pitch seven pitches higher than the reference pitch, are calculated so as to select a single pitch in accordance with the respective selection probabilities. More specifically, of key codes E1(40) to B1(47), the selection probabilities of key codes F#1(42), G#1(44) and B#1(47) are all calculated as "0", and the selection probabilities of the other key codes are calculated as "1". The pitches other than those having the selection probability of "0" will become selectable pitches and be then actually selected depending on the respective selection probabilities. Since the selection probabilities of the selectable pitches are all "1" in the example, a candidate note is selected at random from among the selectable pitches. It is assumed here that key code E1(40) is selected as the candidate note.

After that, the above-described operations are repeated. Namely, the pitch interval "4" is added to key code E1(40) to calculate a reference pitch G#1(44), and a candidate note is selected from among pitches ranging from the reference pitch G#1(44) to the pitch seven pitches higher than the reference pitch, i.e., key codes A1(45), A#1(46), C2(48) and D2(50). It is assumed here that key code A1(53) is selected as the candidate note. Thereafter, the above-described operations are repeated until the selectable pitch exceeds the highest pitch key code F#5(90). It is also assumed now that key codes F2(53), A2(57), E3(64), C4(72), G4(79), A4(81) and E5(88) have been selected by the operations. In FIG. 20, the selected note numbers are shown as enclosed by rectangular frame.

Next, in the second procedure, the group of the notes selected in the above-mentioned first sequence is partly modified in such a manner that the first level note (REQUIRED note) is contained appropriately therein. Assuming that, of the notes selected in the above-mentioned first sequence, key codes C1(36), C4(72), E1(40), E3(64), E5(88) and G4(79) correspond to the first level pitches, no such modification is not necessary because the candidate notes include pitch elements C, E and G corresponding to the first level pitches.

However, there may be many cases where candidate notes do not include pitch elements corresponding to the first level pitches. In such cases, a determination is made as to whether pitch elements having a plurality of candidate notes are present within a range of six pitches from a pitch element corresponding to any of the first level pitches not contained in the candidate notes. If such pitch elements are present, any one of the elements is deleted and a pitch of the same octave level as the deleted element is added to the candidate notes. The term "pitch of the same octave level" as used herein means that a number noted after the key code pitch element (C, D, E, F, G, A, B) is the same.

Assume that key codes D3(62) and D5(86) have been selected as candidate notes in place of key codes C1(36) and C4(72) via the first procedure, in which, of the three pitch elements C, E and G corresponding to the first level pitches, pitch element C is not included in the candidate notes, and pitch element D exists as a pitch element which is within a range from the element C to the one sic pitches higher than the element C (excluding those corresponding to the first level pitch) and has a plurality of candidate notes. Therefore, any one of the key codes of the element D, e.g., key code D3(62) is deleted, and key code C3(60) having the same octave level as the deleted key code is added to the candidate notes, or key code D5(86) is deleted, and key code C5(84) having the same octave level as the deleted key code is added to the candidate notes.

Whereas, in the above-mentioned example, the key code deletion is considered about a range from a first pitch element corresponding to the first level pitch not present in the candidate notes to the one six pitches higher than the first pitch element (excluding those corresponding to the first level pitch), one or more of the candidate notes may be considered which correspond to pitch elements ranging from a first pitch element corresponding to the first level pitch not present in the candidate notes to the one six pitches higher than the first pitch element (excluding those corresponding to the first level pitch). Alternatively, all of the candidate notes may be considered which are within a range from a first pitch element corresponding to the first level pitch not present in the candidate notes to the one six pitches higher than the first pitch element (if only one of the notes corresponds to the first level pitch, then any of the other notes may be considered). Further, although the above-mentioned range has been described above as extending to the pitch element six pitches higher than the first pitch element, it may extend to the pitch lower than the first pitch element by any other number of pitches. In the event that there is no candidate note to be deleted within a range from a first pitch element corresponding to the first level pitch not present in the candidate notes to the one six pitches higher than the first pitch element, a pitch may be randomly selected from among pitch elements corresponding to the first level pitch not present in the candidate notes.

Final determination of chord component tones are made on the basis of the sub-range parameter from among the notes selected in the above-mentioned manner. For example, if the candidate notes are those of FIG. 20 enclosed by rectangular frame, i.e., key codes C1(36), E1(40), A1(45), F2(53), A2(57), E3(64), C4(72), G4(79), A4(81) and E5(88), these notes are placed in the lower-to-higher pitch order as shown in FIG. 21.

Then, chord component tones are determined on the basis of the number of notes depending on the number-of-notes parameter and the sub-range parameter. If the sub-range parameter is "60" as with the register parameter and the number of tones to be sounded is "8" as shown in FIG. 21, eight pitches close to the sub-range parameter value "60", i.e., note numbers "40, 45, 53, 57, 64, 72, 79 and 81", are selected from among the candidate notes; if the number of tones to be sounded is "4", note numbers "53, 57, 64 and 72" will be selected; and if the number of tones to be sounded is "2", note numbers "57 and 64" will be selected. Further, if the sub-range parameter is "45" and the number of tones to be sounded is "4", four pitches close to the sub-range parameter value "45", i.e., note numbers "36, 40, 45 and 53", will be selected from among the candidate notes; if the sub-range parameter is "75" and the number of tones to be sounded is "2", note numbers "64, 72, 79 and 81" will be selected; and if the number of tones to be sounded is "2", note numbers "72 and 79" will be selected. In the event that two of the candidate notes are of the same pitch interval above and below the sub-range, it is possible to select one of the two notes which is closer to a pitch defined by the register parameter or which has a lower or higher absolute pitch value; alternatively, one of the two notes may be selected at random. Where no sub-range parameter is given, chord component tones are selected on the basis of the register parameter value.

Chord pattern data relating to the thus-determined are output to the chord generator 36.

Then, at step 16D of FIG. 16, the value in the slot number register SLOT is incremented by "1", and a determination is made at step 16E as to whether the incremented value has reached "24". If the incremented value of the slot number register SLOT has reached "24", it means that all the operations for one beat has been completed, and thus the CPU 21 returns to the main routine in order to perform the operations for a next beat. If the determination is in the negative at step 16E, the CPU 21 returns to the main routine in order to perform similar operations for a next slot.

In the above-described manner, the pattern reproduction process of FIG. 12 is performed on the basis of the synthesized bass pattern and chord pattern.

Because the described embodiment is arranged in such a manner that performance of bass and chord patterns are executed by the personal computer 20 providing note events to the electronic musical instrument 1H, it can also generate a drum sound in response to a note event output from the personal computer 20, by appropriately setting the tone source in the musical instrument 1H. That is, performance of a bass pattern is permitted by setting the tone source to generate a bass tone in response to a received note event; performance of a chord pattern is permitted by setting the tone source to generate a chord tone (normal scale note such as of piano, strings and guitar) in response to a received note event; and similarly, performance of a drum pattern is permitted by setting the tone source to generate a drum sound in response to a received note event. A drum sound may be generated upon receipt of a note event generated as a chord pattern. Each note number may be set to correspond to a single drum sound, or a plurality of note numbers may be set to correspond to one and the same drum sound, in which case a range may be divided into a plurality of sections so that the first section is allocated for bass drum, the second section for snare drum, the third section for cymbal, etc. The drum sounds may be those of a normal drum set (combination of a bus drum, snare drum, cymbals, etc.) or may be those such as of a tom-tom or timpani having a pitch range. By allowing drum sounds to be generated on the basis of a bass or chord patter, unpredicted advantageous results (better drum pattern) may be achieved. Further, by appropriately setting the pattern creating parameters (texture), it is also possible to create any desired drum patterns.

By virtue of the arrangements having been described so far, the present invention can freely create new accompaniment patterns and make complicated changes to the accompaniment patterns in real time.

What is claimed is:

1. An automatic accompaniment pattern generating device comprising:

parameter supply means for supplying a plurality of parameters including at least one time-varying parameter; and accompaniment pattern forming means for, on the basis of the parameters supplied by said parameter supply means, determining the presence or absence of an accompaniment tone and determining a note for each present accompaniment tone, every one of plural time points within a predetermined time frame, so as to form an accompaniment pattern by assigning the determined note to each of the time points where it has been determined that the accompaniment tone is present.

2. An automatic accompaniment pattern generating device, comprising:

parameter supply means for supplying a plurality of parameters including at least one time-varying parameter;

accompaniment pattern forming means for determining respective note information and sounding timing information of accompaniment tones on the basis of the parameters supplied by said parameter supply means, so as to form an accompaniment pattern comprised of the determined note information and sounding timing information; and chord designation means for designating a chord, wherein said accompaniment pattern forming means determines the note information in consideration of the chord designated by said chord designation means.

3. An automatic accompaniment pattern generating device as defined in claim 2 wherein said parameter supply means includes a data base having stored therein plural groups of parameters and means for selecting an accompaniment style, and wherein said parameter supply means selects and supplies any of the groups of parameters in accordance with the selected accompaniment style.

4. An automatic accompaniment pattern generating device as defined in claim 2 wherein said parameter supply means supplies different said parameters for respective accompaniment parts, and said accompaniment pattern forming means forms respective accompaniment patterns for the accompaniment parts on the basis of the different parameters supplied for the parts.

5. An automatic accompaniment pattern generating device as defined in claim 2 where the parameters supplied by said parameter supply means are parameters for forming chord accompaniment patterns and contains a parameter relating to at least one of duration, stress, number of chord component tones, and density, range, center value and note characteristic of chord component tones.

6. An automatic accompaniment pattern generating device as defined in claim 2 where the parameters supplied by said parameter supply means are parameters for forming bass accompaniment patterns and contains a parameter relating to at least one of duration, stress, pitch changing direction and width, and note characteristic.

7. An automatic accompaniment pattern generating device comprising:

parameter supply means for supplying a plurality of parameters;

performance operator means;

change means for detecting a performance state of said performance operator means, so as to change the parameters supplied by said supply means on the basis of performance states detected at least for a current time and a given past time; and accompaniment pattern forming means for, on the basis of the parameters supplied by said parameter supply means, determining the presence or absence of an accompaniment tone and determining a note for each present accompaniment tone, every one of plural time points within a predetermined time frame, so as to form an accompaniment pattern by assigning the determined note to each of the time points where it has been determined that the accompaniment tone is present, whereby the accompaniment pattern to be formed by said accompaniment pattern forming means is changed in response to a changing real-time performance via said performance operator means.

8. An automatic accompaniment pattern generating device comprising:

parameter supply means for supplying a plurality of parameters;

performance operator means;

chance means for detecting a performance state of said performance operator means, so as to change the parameters supplied by said supply means on the basis of performance states detected at least for a current time and a given past time; and accompaniment pattern forming means for determining respective note information and sounding timing information of accompaniment tones on the basis of the parameters supplied by said parameter supply means, so as to form an accompaniment pattern comprised of the determined note information and sounding timing information;

whereby the accompaniment pattern to be formed by said accompaniment pattern forming means is changed in response to a changing real-time performance via said performance operator means, wherein said parameter supply means selects and supplies parameters from among a multiplicity of parameters in accordance with the detected performance state of said performance means.

9. An automatic pattern generating device as defined in claim 8 wherein said change means has a plurality of predetermined data defining how the parameters are to be changed on the basis of the detected performance state, and wherein said change means changes the parameters on the basis of the detected performance state in such a manner as defined by selected one of the predetermined data.

10. An automatic accompaniment pattern generating device as defined in claim 8 wherein said parameter supply means has plural types of parameters in such a manner that each said type contains two or more parameters, and said parameter supply means selects any of the two or more parameters for each said type in accordance with the detected performance state.

11. An automatic accompaniment pattern generating device as defined in claim 8 wherein said change means has modulating data for changing the parameters, and said change means changes the modulating data in accordance with the detected performance state.

12. An automatic accompaniment pattern generating device as defined in claim 9 wherein on the basis of the detected performance state, said change means makes a selection as to whether the parameters are to be changed or not.

13. An automatic accompaniment pattern generating device comprising:

input means for inputting performance information to said device;

parameter preparation means for analyzing the performance information inputted by said input means and preparing a parameter in accordance with the analyzed performance information; and accompaniment pattern forming means for determining respective note information and sounding timing information of accompaniment tones on the basis of the parameter prepared by said parameter preparation means, so as to form an accompaniment pattern comprised of the determined note information and sounding timing information.

14. An automatic accompaniment pattern generating device as defined in claim 13 wherein said parameter preparation means includes means for generating a parameter in accordance with the analyzed performance information, and means for changing the parameter by operating the generated parameter with an optional offset value.

15. An automatic accompaniment pattern generating device as defined in claim 13 wherein said parameter preparation means includes means for preparing first-group parameters of plural types in accordance with the analyzed performance information, means for supplying second-group parameters of plural types prepared in advance, and means for selecting either of said first- and second-group parameters for each said parameter type.

16. An automatic accompaniment pattern generating device as defined in claim 13 wherein said parameter preparation means includes means for preparing a parameter in accordance with the analyzed performance information and means for delaying the prepared parameter by a predetermined time and supplying the delayed parameter to said accompaniment pattern forming means.

17. An automatic accompaniment pattern generating device comprising:

parameter supply means for supplying a plurality of parameters;

performance operator means;

modulation means for modulating at least one of the parameters to be supplied by said parameter supply means in accordance with a performance state of said performance operator means; and accompaniment pattern forming means for, on the basis of the parameters supplied by said parameter supply means, determining the presence or absence of an accompaniment tone and determining a note for each present accompaniment tone, every one of plural time points within a predetermined time frame, so as to form an accompaniment pattern by assigning the determined note to each of the time points where it has been determined that the accompaniment tone is present, wherein the accompaniment pattern to be formed by said accompaniment pattern forming means is changed in response to a changing real-time performance via said performance operator means.

18. An automatic accompaniment pattern generating device comprising:

parameter supply means for supplying a plurality of parameters;

performance operator means;

modulation means for modulating at least one of the parameters to be supplied by said parameter supply means in accordance with a performance state of said performance operator means; and accompaniment pattern forming means for determining respective note information and sounding timing information of accompaniment tones on the basis of the parameter modulated by said modulation means, so as to form an accompaniment pattern comprised of the determined note information and sounding timing information, whereby the accompaniment pattern to be formed by said accompaniment pattern forming means is changed in response to a changing real-time performance via said performance operator means, and wherein said modulation means includes means for adding a given value depending on the performance state to the parameter supplied by said parameter supply means.

19. An automatic accompaniment pattern generating device as defined in claim 18 wherein said modulation means includes means for operating the parameter supplied by said parameter supply means with a predetermined offset value, and means for changing the predetermined offset value in accordance with the performance state.

20. An automatic accompaniment pattern generating device as defined in claim 18 wherein said modulation means performs control to make a selection, in accordance with the performance state, as to whether the parameter supplied by said supply means is to be changed or not.

21. A method for automatically generating an accompaniment pattern, said method comprising the steps of:

supplying a plurality of parameters including at least one time-varying parameter;

designating a chord;

determining respective note information and sounding timing information of accompaniment tones on the basis of the supplied parameters, said note information being determined in consideration of the chord designated by said step of designating; and forming an accompaniment pattern comprised of the determined note information and sounding timing information.

22. The method of claim 21 further comprising the steps of:

storing plural groups of parameters as a data base; and selecting an accompaniment style, where in any of the groups of parameters are selected and supplied as the plurality of parameters in accordance with the selected accompaniment style.

23. The method of claim 21 further comprising the steps of:

detecting performance states of a performance operator by a performer; and changing the plurality of parameters on the basis of performance states at least for a current time and a given past time, wherein the respective note information and sounding timing information of accompaniment tones is determined on the basis of the changed plurality of parameters, and the accompaniment pattern to be formed is changed in response to a changing real-time performance operation by the performer.

24. A method for automatically generating an accompaniment pattern, said method comprising the steps of:

inputting performance information;

analyzing the inputted performance information;

preparing a parameter in accordance with the analyzed performance information;

determining respective note information and sounding timing information of accompaniment tones on the basis of the prepared parameter; and forming an accompaniment pattern including the determined note information and sounding timing information.

25. A machine readable media for use in a data processing system including a CPU, said media containing instructions executable by said CPU for causing said system to perform the steps of:

supplying a plurality of parameters including at least one time-varying parameter;

designating a chord;

determining respective note information and sounding timing information of accompaniment tones on the basis of the supplied parameters, said note information being determined in consideration of the chord designated by said step of designating; and forming an accompaniment pattern comprised of the determined note information and sounding timing information.

26. A machine readable media according to claim 25, wherein the method further comprises the steps of:

storing plural groups of parameters as a data base; and selecting an accompaniment style, wherein any of the groups of parameters are selected and supplied as the plurality of parameters in accordance with the selected accompaniment style.

27. A machine readable media according to claim 25, wherein the method further comprises the steps of:

detecting performance states of a performance operator by a performer; and changing the plurality of parameters on the basis of performance states at least for a current time and a given past time, wherein the respective note information and sounding timing information of accompaniment tones is determined on the basis of the changed plurality of parameters, and the accompaniment pattern to be formed is changed in response to a changing real-time performance operation by the performer.

28. A machine readable media for use in a data processing system including a CPU, said media containing instructions executable by said CPU for causing said system to perform the steps of:

inputting performance information;

analyzing the inputted performance information;

preparing a parameter in accordance with the analyzed performance information;

determining respective note information and sounding timing information of accompaniment tones on the basis of the prepared parameter; and forming an accompaniment pattern including the determined note information and sounding timing information.

29. An automatic accompaniment generating device, comprising:

a parameter supplying device for supplying analytic parameters analytically describing an accompaniment performance;

a determining device for, on the basis of the analytic parameters supplied by said parameter supplying device, determining presence or absence of an accompaniment tone and determining a note for each present accompaniment tone, every one of plural time points within a predetermined time frame; and a pattern forming device for forming an accompaniment pattern by assigning the determined note to each of the time points where said determining device has determined that the accompaniment tone is present.

30. An automatic accompaniment generating device as defined in claim 29, which further comprises a changing device for changing at least one parameter selected from among the analytic parameters.

31. A method for creating an accompaniment pattern comprising the steps of:

supplying analytic parameters analytically describing an accompaniment performance;

determining the presence or absence of an accompaniment tone and determining a note for each present accompaniment tone, every one of plural time points within a predetermined time frame on the basis of the analytic parameters supplied by said parameter supplying device; and forming an accompaniment pattern by assigning the determined note to each of the time points where said determining device has determined that the accompaniment tone is present.

32. A machine readable media for use in a data processing system including a CPU, said media containing instructions executable by said CPU for causing said system to perform the steps of:

supplying analytic parameters analytically describing an accompaniment performance;

determining the presence or absence of an accompaniment tone and determining a note for each present accompaniment tone, every one of plural time points within a predetermined time frame on the basis of the analytic parameters supplied by said parameter supplying device; and forming an accompaniment pattern by assigning the determined note to each of the time points where said determining device has determined that the accompaniment tone is present.

* * * * *